US005152271A

United States Patent [19]

Matsumura

[11] Patent Number: 5,152,271

[45] Date of Patent: Oct. 6, 1992

[54] FUEL INJECTION APPARATUS

[76] Inventor: Osamu Matsumura, 2-20-11, Higashi-cho,, Kaganei-shi, Tokyo, Japan

[21] Appl. No.: 338,351

[22] Filed: Apr. 12, 1989

Related U.S. Application Data

[63] Continuation of Ser. No. 859,361, May 5, 1986, abandoned.

[30] Foreign Application Priority Data

| | | | |
|---|---|---|---|
| Jul. 15, 1985 | [JP] | Japan | 60-155675 |
| Oct. 8, 1985 | [JP] | Japan | 60-224392 |
| Nov. 19, 1985 | [JP] | Japan | 60-259592 |
| Jan. 23, 1986 | [JP] | Japan | 61-12775 |

[51] Int. Cl.[5] ..... F02M 37/04

[52] U.S. Cl. ..... 123/504; 123/447

[58] Field of Search ..... 123/458, 497, 498, 499, 123/504, 447, 467

[56] References Cited

U.S. PATENT DOCUMENTS

| | | | |
|---|---|---|---|
| 3,827,409 | 8/1974 | O'Neill | 123/456 |
| 3,913,547 | 10/1975 | Wentworth | 123/497 |
| 3,965,876 | 6/1976 | Tissot . | |
| 3,967,598 | 7/1976 | Rachel | 123/497 |
| 3,995,813 | 12/1976 | Bart et al. . | |
| 4,342,443 | 8/1982 | Wakeman | 123/472 |
| 4,359,032 | 11/1982 | Ohie | 123/467 |
| 4,359,984 | 11/1982 | Nakao | 123/497 |
| 4,388,053 | 6/1983 | Bartel | 123/447 |
| 4,462,368 | 7/1984 | Funada . | |
| 4,501,245 | 2/1985 | Taira | 123/504 |
| 4,529,164 | 7/1985 | Igashira | 123/504 |
| 4,546,739 | 10/1985 | Nakajima | 123/472 |
| 4,627,403 | 9/1986 | Matsumura . | |
| 4,658,824 | 4/1987 | Scheide | 123/472 |
| 4,669,429 | 6/1987 | Nishida | 123/447 |
| 4,712,528 | 12/1987 | Schaffitz | 123/497 |
| 4,884,545 | 12/1989 | Mathis | 123/497 |

FOREIGN PATENT DOCUMENTS

| | | | |
|---|---|---|---|
| 1751543 | 8/1970 | Fed. Rep. of Germany . | |
| 3039972 | 5/1982 | Fed. Rep. of Germany | 123/498 |
| 3030378 | 2/1983 | Fed. Rep. of Germany . | |
| 3442022 | 5/1985 | Fed. Rep. of Germany . | |
| 3411539 | 10/1985 | Fed. Rep. of Germany . | |
| 3517611 | 12/1985 | Fed. Rep. of Germany . | |
| 820568 | 9/1959 | United Kingdom . | |
| 1465283 | 2/1977 | United Kingdom . | |
| 2056557 | 3/1981 | United Kingdom . | |

*Primary Examiner*—Carl S. Miller

*Attorney, Agent, or Firm*—James P. Ryther

[57] ABSTRACT

Fuel is pumped and supplied to an injector which injects the fuel in the form of mist. The quantity of fuel injected from the nozzle is regulated by quantity control means. The control means is comprised of a control valve, which is disposed on the injection hole of the injector for controlling the area of the injection hole. When the control valve has sufficient stroke to close the injection hole, the valve serves not only as a control valve, but also as a timing control valve. The movement or stroke of the control valve is accomplished by an actuator which is controlled by electrical control means, for example a microcomputer, to enable a precise injection of fuel and an ideal combustion.

19 Claims, 24 Drawing Sheets

FUEL INJECTION APPARATUS

This application is a continuation of application Ser. No. 859,361, filed May 5, 1986 now abandoned.

BACKGROUND OF THE INVENTION

1. Field of the Invention

This invention generally relates to a fuel injection apparatus for an internal combustion engine, and more particularly, this invention is intended to, but not limited to a fuel injection apparatus for a compression ignition engine or a Diesel engine.

2. Description of Prior Art

The conventional Diesel engine has a fuel injection pump for injecting fuel into each of the cylinders. The fuel injection pump pumps the fuel and supplies it to the fuel injector which has an injecting nozzle. A timer is provided on a cam shaft of the fuel injection pump for controlling the timing of the fuel injection. The injection pump also requires a mechanical governor, which is connected to a control rack of the pump for regulating the quantity of fuel injected at one time, and to thereby ensure the supply of a suitable quantity of fuel to the engine in response to the condition thereof.

In sum, the conventional fuel injection apparatus includes a fuel injection pump, a mechanical governor and a timer, which are all comprised of complex mechanical structures, thus making the fuel injection apparatus very expensive. Furthermore, these complex apparatus require highly skilled maintenance. Moreover, the conventional fuel injection apparatus is not suitable for electric control by a microcomputer or the like. Additionally in using the conventional apparatus, it is very difficult to control the pattern of fuel injection, and more specifically it is very difficult to decrease the quantity of fuel at the initial period of the injection. Therefore the engine generates noises and contains a great deal of nitrogen oxide in the much exhaust gas of the engine.

OBJECTS OF THE INVENTION

One object of this invention is to provide a simple and inexpensive fuel injection apparatus.

Another object of this invention is to provide a fuel injection apparatus which does not require highly skilled maintenance.

A further object of this invention is to provide a fuel injection apparatus which is completely electrically controlled.

Still further object of this invention is to provide a fuel injection apparatus, in which the quantity of fuel is decreased during the initial fuel injection period in order to decrease the engine noise and nitrogen oxide in the exhaust gas.

In accordance with one aspect of this invention, is provided a fuel injection apparatus wherein the fuel is pressed and supplied to the fuel injector, the fuel is then injected through the injection hole of the injector in the form of mist, and the injector includes a quantity control valve for regulating the effective area of the injection hole and an actuator for moving or displacing the quantity control valve, the quantity of fuel in the initial injection period being decreased by the actuator and the quantity control valve.

The above, and other objects, features and advantages of the invention will be apparent from the following detailed description of illustrative embodiments which are to be read in conjunction with the accompanying drawings.

DETAILED DESCRIPTION OF PREFERRED EMBODIMENT

Figure 1:
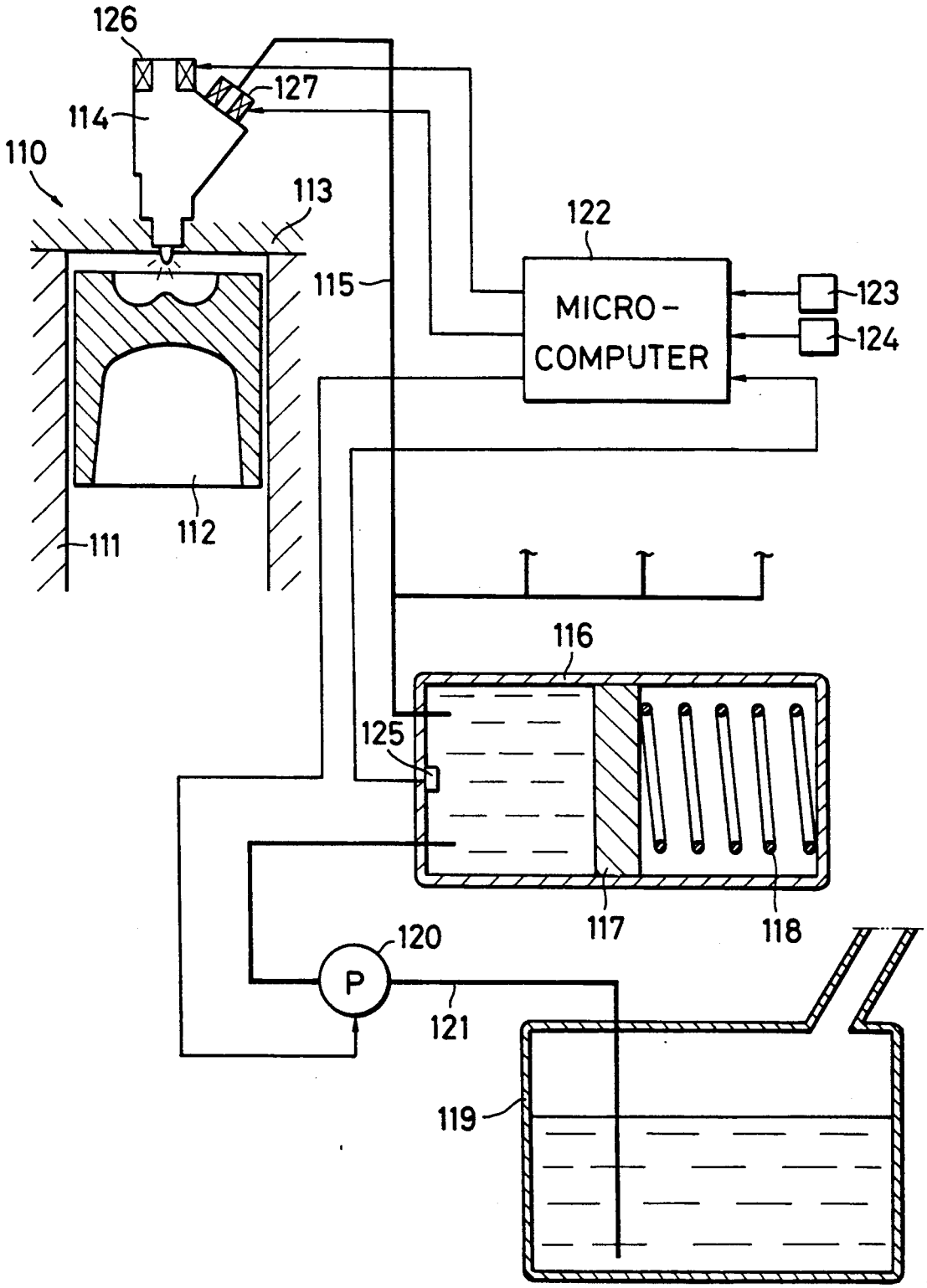
FIG. 1 is a block diagram of the fuel injection apparatus according to the first embodiment.

Described below are the embodiments of this invention in accordance with the accompanying drawings. FIG. 1 shows a first embodiment of the fuel injection apparatus according to this invention. The Diesel engine 110 includes a cylinder 111 which receives a piston 112 slidably. The top of the cylinder 111 is closed by a cylinder head 113. The cylinder head 113 is provided with an injector 114 for injecting fuel into the cylinder 111. The fuel injected from the injector 114 is ignited by the air because the air is compressed and the temperature is raised, causing combustion and generating torque.

The fuel injector 114 is connected to an accumulator 116 by a fuel feed pipe 115. The accumulator 116 has a piston 117 which is pushed by a coil spring 118. Accordingly, the fuel in the accumulator 116 is pushed and held under pressure by the spring 118. Furthermore, the accumulator 116 is connected to a fuel tank 119 by a feed pipe 121, which is connected to a high pressure feed pump 120.

The fuel injection apparatus shown in FIG. 1 also includes a microcomputer 122 for controlling the injector 114. The microcomputer 122 is connected to a revolution detecting sensor 123 for detecting the revolutional number of engine 110 and a load sensor 124 for detecting the load of the engine 110. Additionally, a pressure sensor 125 for detecting the pressure of the fuel in the accumulator 116 is connected to the microcomputer 122. The microcomputer 122 controls an actuator 126 for controlling the quantity of fuel and an actuator 127 for controlling a timing of the injection. These actuators 126 and 127 are provided on the fuel injector 114.

Figure 2:
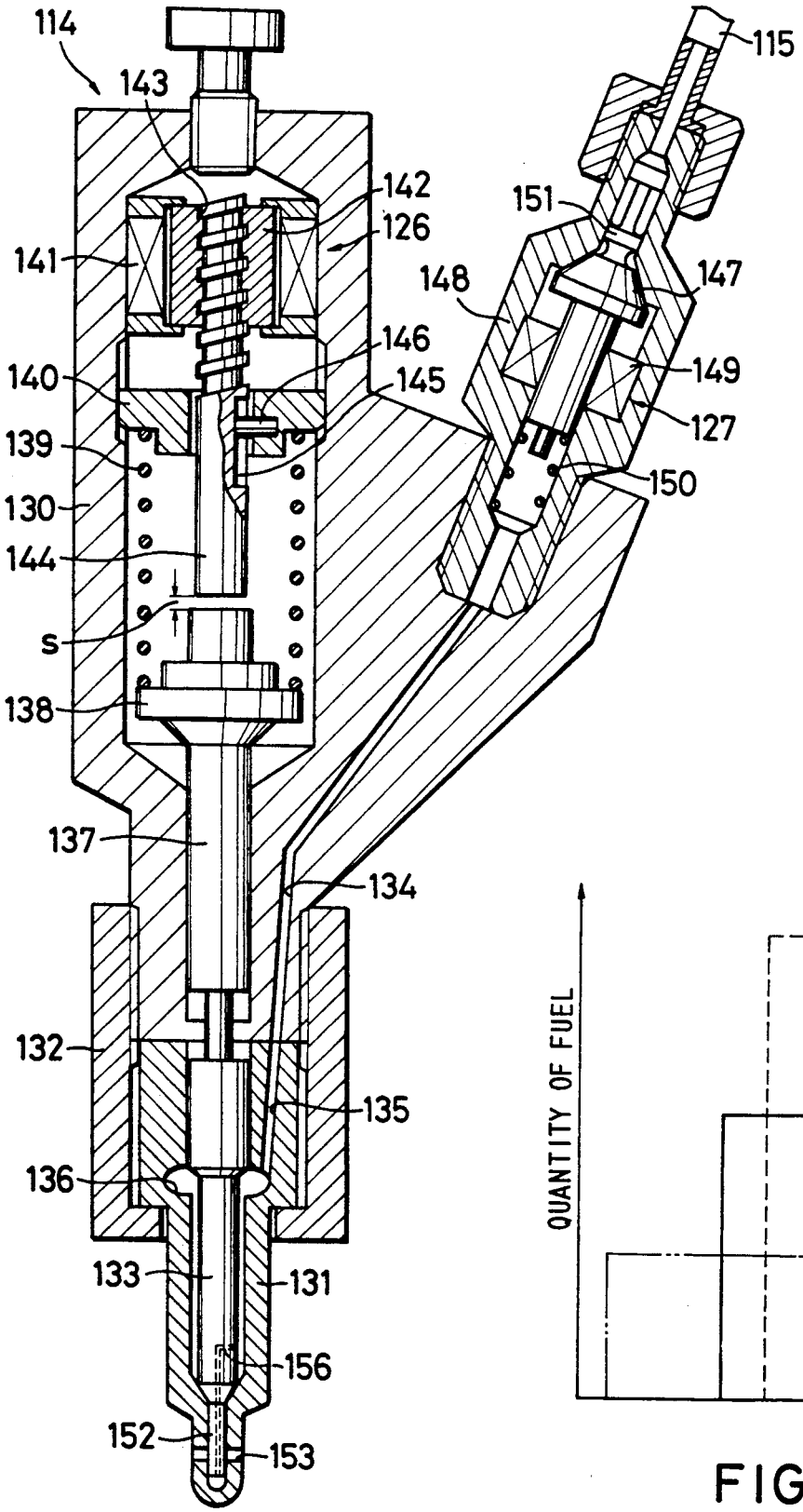
FIG. 2 is a cross section of the injector shown in FIG. 1.

Next, the structure of the fuel injector 114 will be described. As shown in FIG. 2, the injector 114 includes a body 130 and a nozzle 131 which is secured at the bottom of the body 130 by a sleeve 132. The nozzle 131 receives a nozzle needle 133 slidably in the axial direction. Additionally in this nozzle 131, is formed a reservoir 136 for communicating with a passage 134 of the body 130 and the passage 135 of the nozzle 131. The fuel in the reservoir 136 pushes and moves the nozzle needle 133 upward in the axial direction.

The upper end of the nozzle needle 133 contacts the bottom end of a push rod 137. The push rod 137 is received in the body 130 and is slidably supported in the axial direction. A spring seat 138 is formed on the upper end of the push rod 137 and the seat 138 receives the lower end of a coil spring 139. The top end of teh spring 139 is received by a spring seat 140 provided inside the body 130.

In the body 130 and on the spring seat 140, is provided the actuator 126 for controlling the quantity of fuel. The actuator 126 includes a coil 141 and a rotor 142 which is rotatablly supported inside the coil 141. A through hole 143 with a female thread is formed at the center of the rotor 142, and a male thread formed on the peripheral surface of a stopper 144 engages the femal thread. Further, a longitudinal slot 145 is formed on the stopper 144, and the slot 145 receives a pin 146 which is secured on the spring seat 140 to prevent the rotation and to permit the axial displacement of the stopper 144.

Next, will be described a valve member 147 provided on the fuel injector 114. The valve member 147 is slidably supported in a casing 148. The valve member 147 is opened by the magnetic force of a coil 149. The valve member 147 is pushed to the closed position by a coil spring 150 held in the casing 148. A suck valve 151 is formed at the top of the valve member 147. The suck valve 151 closes before the valve member 147 closes to suck the fuel in the passages 134 and 135 and the reservoir 136, thereby resulting a sharp decrease in fuel.

Next, a quantity control valve 152 will be described in accordance with FIG. 3 and FIG. 4. A small column is formed at the top of the nozzle needle 133 and the column constitutes a control valve 152. On the peripheral surface of the control valve 152 are formed oblong slots 154 which coincide with the injection hole of the nozzle 131, and the oblong slot 154 is communicating with a slot 155 for feeding fuel. Furthermore, a through hole 156 is formed at the center of the quantity control valve 152, and the fuel in the top end of the nozzle body 131 and the top of the control valve 152 is relieved through the hole 156.

Next, an operation of the fuel injection apparatus according to this embodiment will be described. The fuel in the fuel tank 119 is sucked by the high pressure feed pump 120 and the fuel is pumped and pushed into the accumulator 116. The pressure of the fuel in the accumulator 116 is detected by the pressure sensor 125 and the information of the detected value is supplied to the microcomputer 122. The microcomputer 122 controls the feed pump 120 in response to the detected pressure. Therefore, it is possible to maintain the pressure of the fuel in the accumulator 116 substantially constant, and the fuel is held under the predetermined pressure. The fuel is supplied to the injector 114 through the fuel feed pipe 115 and injected through the injection hole 153 when the valve member 147 is opened by the timing control actuator 127. The quantity of fuel injected per unit time is controlled by the quantity control valve 152 which is controlled by the quantity control actuator 126.

Figure 7:
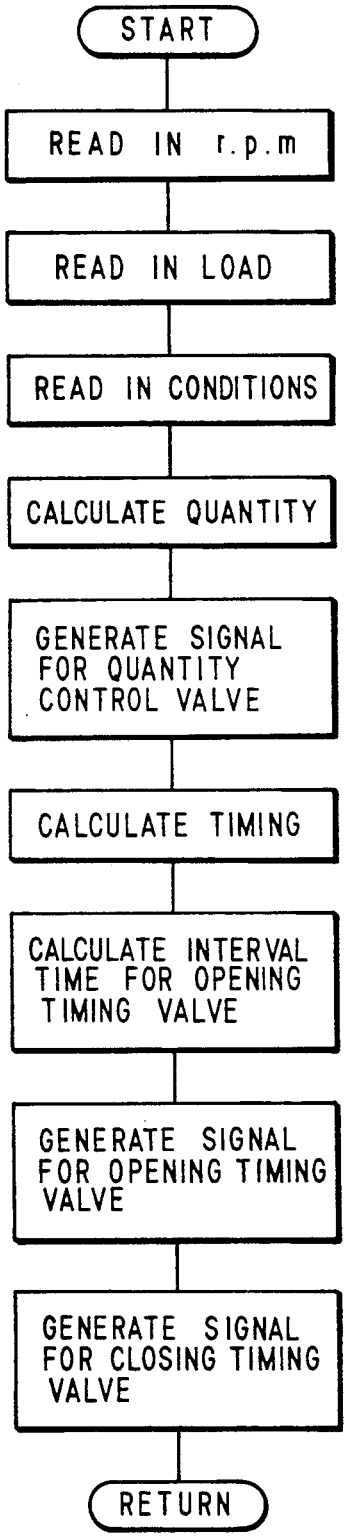
FIG. 7 is a flow chart of the operation of the injection apparatus.

As specifically shown in FIG. 7, the microcomputer 122 reads in the number of revolutions and the load of the engine 110 through the revolution detecting sensor 123 and the load sensor 124. The microcomputer 122 also reads in various conditions existing at the moment. These conditions include a demand for increased fuel for cranking, a demand for constant speed revolution, a demand for a constant speed running or the like. Based on these informations, the microcomputer 122 calculates a suitable quantity of fuel to be injected, and based on this calculation the microcomputer 122 calculates the appropriate size of the injection hole 153. In response to this calculation the microcomputer 122 supplies a control signal to the actuator 126 for controlling the quantity of fuel. Thus the actuator 126 operates a quantity control.

Namely, the actuator 126 is provided with a coil 141 which constitutes a stepping motor, and the coil 141 is energized in response to the control signal from the microcomputer 122 causing the rotor 142 to rotate. The rotor 142 has a through hole 143 with female thread at the center thereof, and the female thread is engaged with a male thread formed on the peripheral surface of the stopper 144, and further the stopper 144 is prevented from rotation by the pin 146 which is received by the longitudinal slot 145 of the stopper 144. Accordingly, the stopper 144 displaces axially when the electric current is supplied to the coil 141 and the rotor 142 is rotated. Thus a gap S between the bottom of the stopper 144 and the top of the spring seat 138 is regulated.

The stopper 144 defines or limits the upward displacement of the push rod 137, and as in the case shown in FIG. 2, the push rod 137 is permitted to displace upward in the stroke S. Furthermore, as the bottom end of the push rod 137 contacts with the nozzle needle 133, a displacement of the nozzle needle 133 is also limited to the stroke S. Accordingly, the microcomputer 122 controls the stroke of the upward displacement of the nozzle needle 133 through the quantity control actuator 126. That is, when the timing valve 147 is opened, the compressed fuel is supplied to the reservoir 136 through the valve 147 and passages 134 and 135, and the nozzle needle 133 moves upward against the coil spring 139 by the pressure of the fuel. The stroke of the nozzle needle 133 is S in this case.

Figure 3:
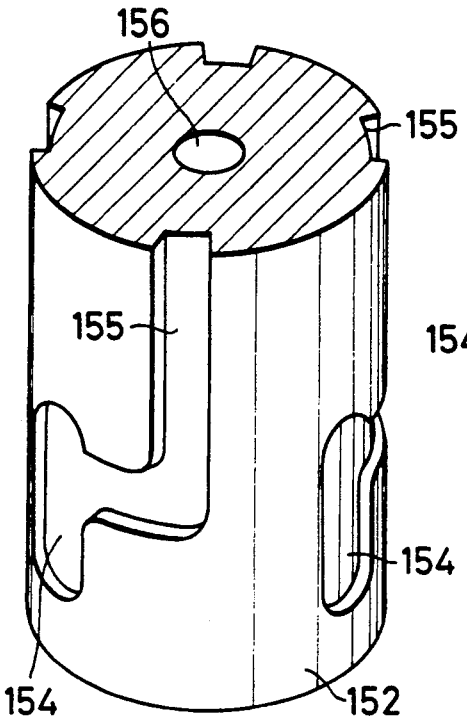
FIG. 3 is a perspective view of an enlarged quantity control valve of the injector.
Figure 4:
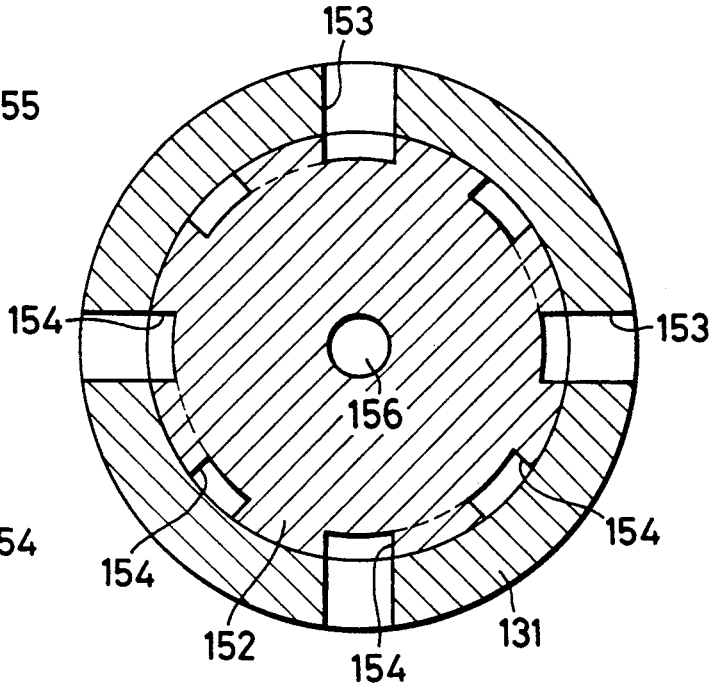
FIG. 4 is a cross section of the injection nozzle.
Figure 5:
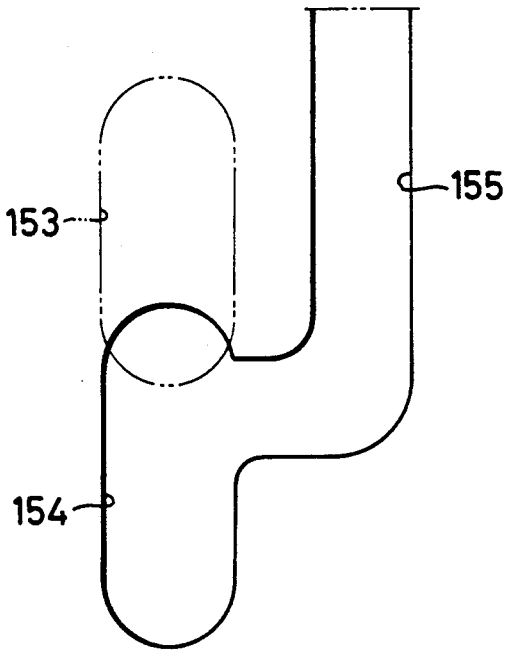
FIG. 5 is a front view of an oblong slot formed on the quantity control valve.
Figure 6:
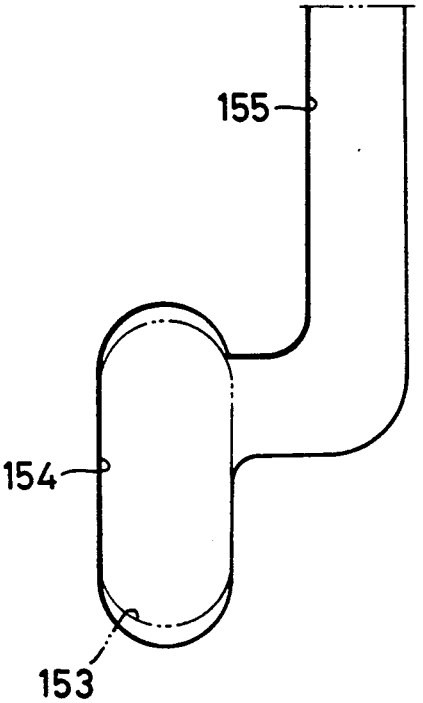
FIG. 6 is a front view of the oblong slot which substantially coincides with the injection hole.

The quantity control valve 152 is integrally formed at the top end of the nozzle needle 133, as shown in FIG. 3 and FIG. 4, and the oblong slot 154 and feeding slot 155 are formed on the peripheral surface of the quantity control valve 152. In a case that the stroke of upward displacement of the nozzle needle 133 is small, as shown in FIG. 5, the oblong slot 154 partially coincides with the injection hole 153 when the nozzle needle 133 moves upward. Therefore, in this case the effective area of the injection hole 153 is very small and the quantity of the fuel injected per unit time is also small. In comparison, when the stroke of upward displacement of the nozzle needle 133 is long, as shown in FIG. 6, the oblong slot 154 substantially fully coincides with the injection hole 153, and the effective area of the injection hole 153 is very large. Hence, in this case the quantity of fuel injected per unit time is very great. Accordingly, the microcomputer 122 controls the actuator 126 which controls the axial position of the stopper 144, and by this stopper 144 regulates the stroke of the nozzle needle 133. Hence, the portion of the length or the area of the slot 154 which coincides with the injection hole 153 is varied or regulated, and hence the effective area of the injection hole is regulated to control the quantity of fuel.

As shown in FIG. 7, the microcomputer 122 also calculates the time duration of injection after the above mentioned control operation. The microcomputer 122 reads in the angular position of the crank shaft of the engine 110 through the revolution detecting sensor 123, and then the microcomputer 122 generates a signal for opening the valve 147 at the proper moment. In response to the opening signal, the coil 149 of the timing actuator 127 is energized and the valve 147 is opened against the coil spring 150. The compressed fuel is then supplied to the top of the injector 114 through the fuel feed pipe 115 and the casing 148 of the valve 147. After the abovementioned time duration has passed, the microcomputer 122 generates a closing signal, and in response to this signal the coil 149 of the actuator 127 is deenergized. Accordingly, the coil spring 150 closes the valve 147. Additionally, the suck valve 151 is closed prior to the closing of the valve 147, and hence the pressure of the fuel in the passages 134, 135 and the reservoir 136 is suddenly decreased. For this reason, the injection of the fuel is accurately terminated.

Figure 8:
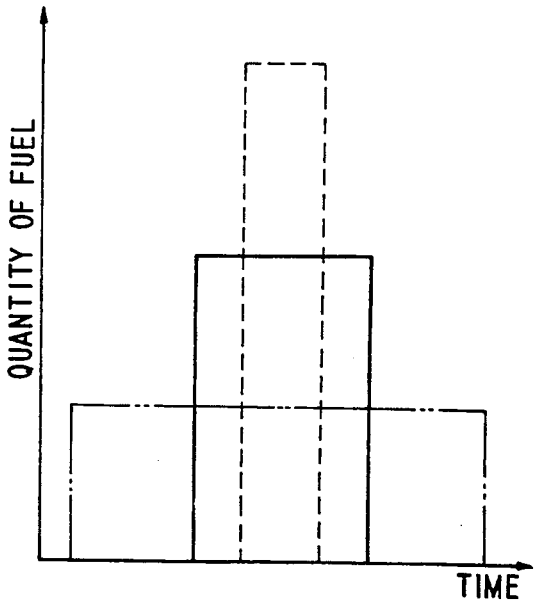
FIG. 8 is a diagram of the injection pattern according to this embodiment.

FIG. 8 shows an injection pattern of this embodiment. The feature of this pattern is a square shape. The width of the square pattern or the length along the horizontal or time axis represents the time duration that the valve 147 is open. On the contrary, the height of the square pattern along the vertical axis substantially represents the effective area of the injection hole 153. Therefore, various types of injection patterns are accomplished by the combination of the time duration the valve 147 is open and the effective area of the injection hole 153. The standard pattern is shown by the solid line in FIG. 8. Another pattern shown by a chain line in FIG. 8 is obtained when the effective area of the injection hole is narrowed and the time duration is delayed. In comparison, a pattern shown by dotted line in FIG. 8 is obtained when the time duration is short and the effective area of the injection hole 153 is enlarged. Furthermore, when the injection pattern is moved along the time axis, the fuel injection is advanced or delayed to control the injection timing.

Figure 9:
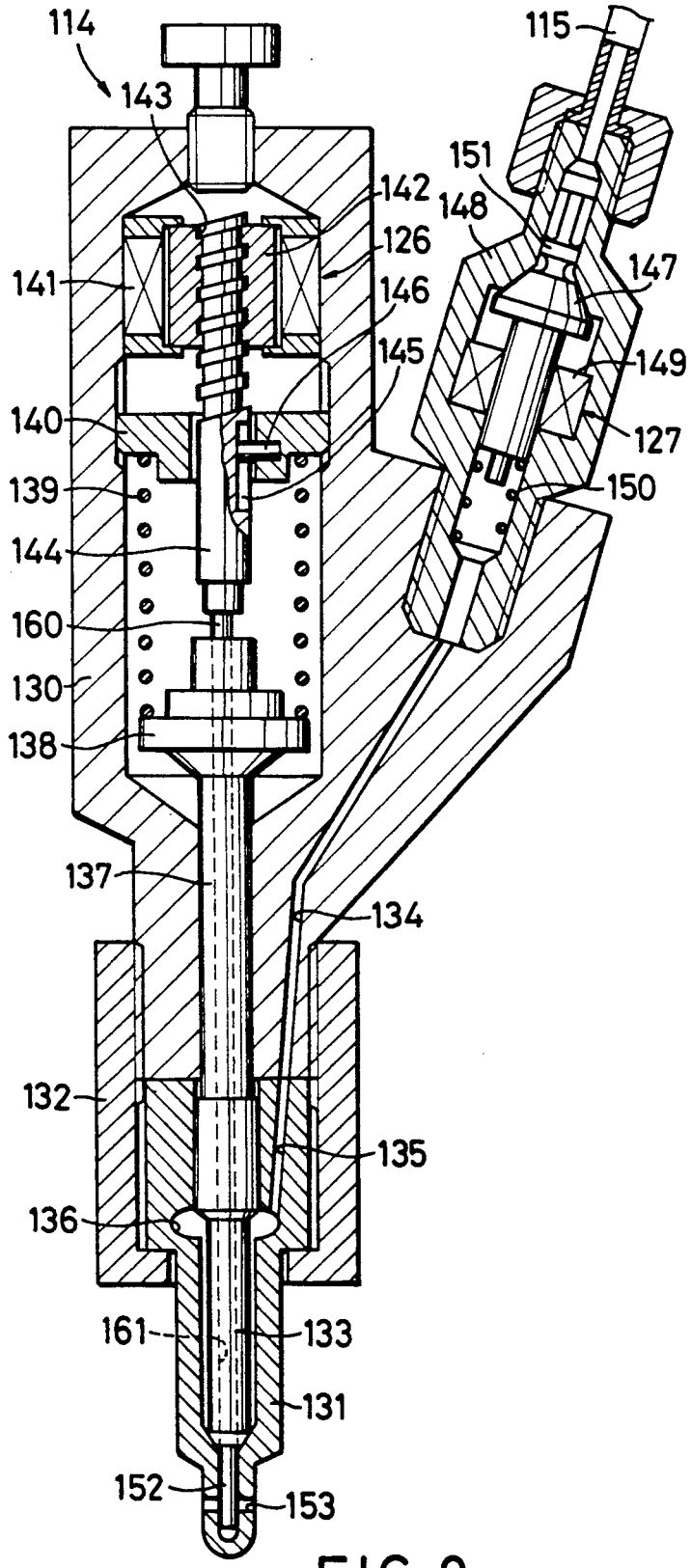
FIG. 9 is a cross section of a modified injector.
Figure 10:
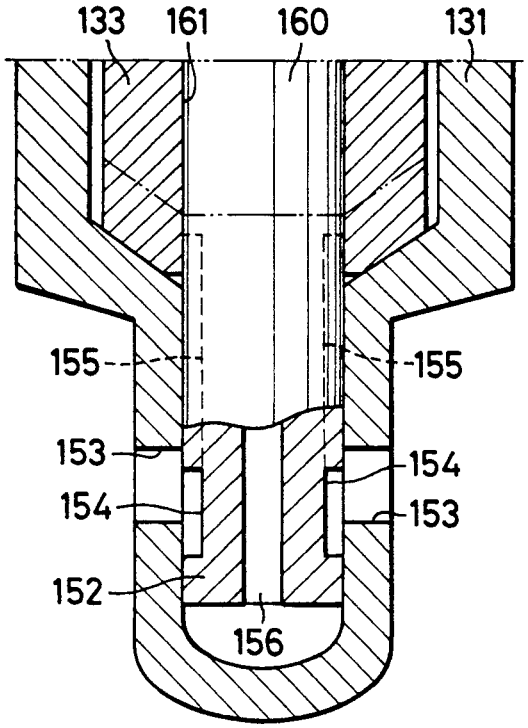
FIG. 10 is an enlarged cross section of the injection nozzle.
Figure 12:
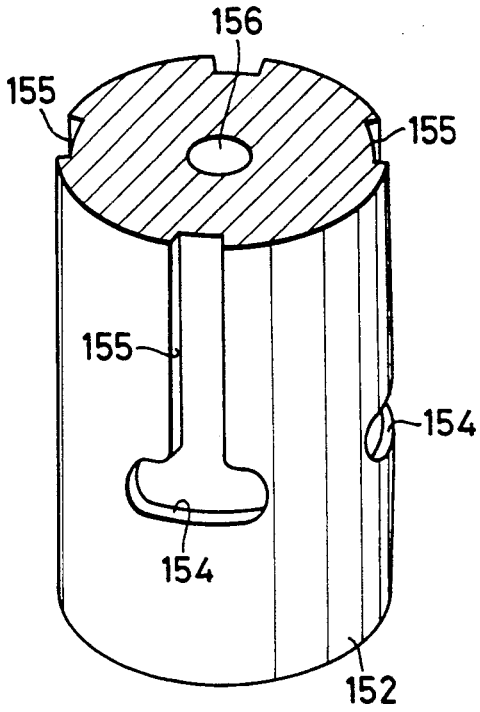
FIG. 12 is an enlarged perspective view of the quantity control valve of the injector shown in FIG. 11.

Next, will be described a modified embodiment with reference to FIG. 9 and FIG. 10. In the modification, the corresponding portions identical to those in the first embodiment are denoted by the same reference numerals and a description of aspect that have the same construction as those in the first embodiment will be omitted. In the modification, the quantity control valve 152 is separated from the nozzle needle 133 and the movement of the quantity control valve 152 is in dependent of the nozzle needle 133. That is, the quantity control valve 152 is connected to a connecting rod 160, and the rod 160 passes through the through hole 161 formed on the center of the nozzle needle 133. The top of the connecting rod 160 is connected to the out-put shaft 144 of the quantity control actuator 126. The structure of the output shaft 144 is the same as in the first embodiment. The male thread formed on the peripheral surface thereof engages the female thread 143 of the rotor 142, and the longitudinal slot 145 of the shaft 144 receives a pin 146 secured on the spring seat 140 to prevent the rotation of the shaft 144.

Accordingly, by this modification, the rotor 142 rotates when the coil 141 is energized in response to the control signal from the microcomputer. The revolutional movement of the rotor 142 is transformed to an axial movement of the out-put shaft 144. This movement is transmitted to the quantity control valve 152 by the connecting rod 160, which thereby displaces the quantity control valve 152 axially to the predetermined position. The area of the injection hole 153 then coincides with the oblong slot 154 of the quantity control valve 152, thereby regulating the effective area of the injection hole 153. The quantity control valve 152 stops in this position when the effective area of the injection hole 153 is controlled.

According to this modification, the quantity control valve 152 does not move upward for every injection. The valve 152 stays in its still position when a quantity control operation is not performed, because the quantity control valve 152 is separate from the nozzle needle 133. Accordingly, the nozzle needle 133 moves from its initial position shown by the solid line in FIG. 10, to the position shown by the chain line and the nozzle needle 133 is separated from the valve seat when the timing valve 147 is opened and compressed fuel is supplied to the reservoir 136. Therefore, the fuel is supplied through the slot 155 for feeding fuel and the oblong slot 154 of the quantity control valve 152, and the fuel is injected through the injection hole 153 in the form of mist.

Another modification of the embodiment will be described with reference to FIG. 11 to FIG. 14. In this modification, the same reference numerals as above will be denoted for the corresponding portions and descriptions of similar constructions will be omitted. The feature of this modification is that the slot 154 of the quantity control valve 152 for controlling the injection hole 153 extends in a circular direction, and the effective area of the injection hole 153 is controlled by the rotation of the quantity control valve 152. The rotor 142 of the actuator 126 for controlling quantity is connected to the out-put shaft 144, and the out-put movement of the actuator 126 is accomplished by the rotation of the shaft 144. The top end of the shaft 144 is connected to the quantity control valve 152 by the connecting rod 160.

Figure 13:
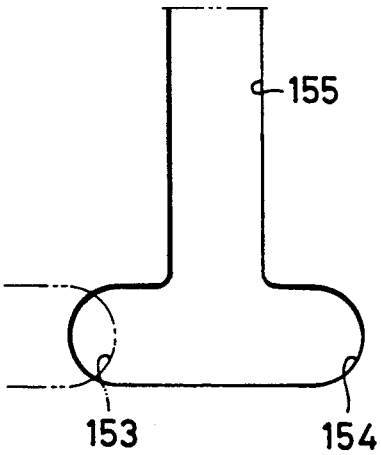
FIG. 13 is a front view of the slot formed on the injection control valve.
Figure 14:
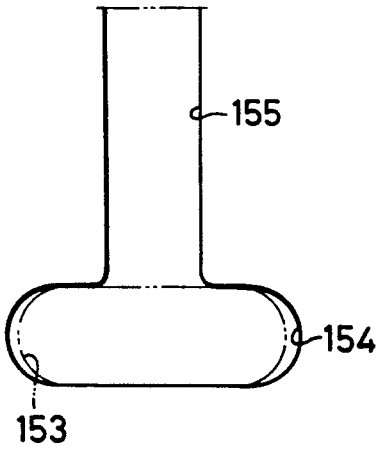
FIG. 14 is a front view of the slot which substantially coincides with the injection hole.
Figure 11:
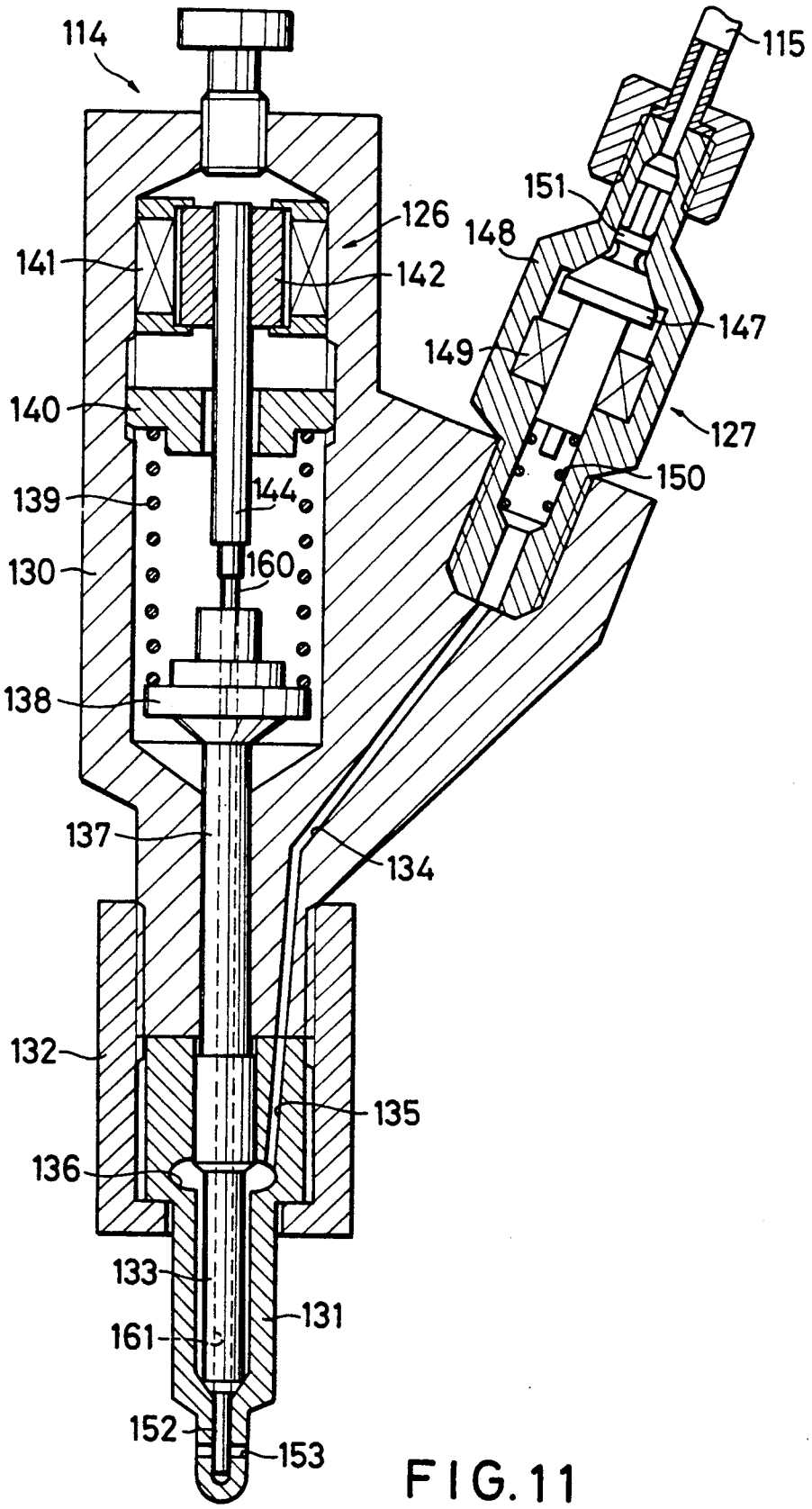
FIG. 11 is a cross section of another modified injector.

By the arrangement of this modification, the rotor 142 rotates when the coil 141 is energized in response to the control signal of the microcomputer, and the rotation is transmitted to the quantity control valve 152 through the output shaft 144 and the connecting rod 160. Accordingly, the quantity of fuel injected per unit time is decreased when the coinciding area between the injection hole 153 and the oblong slot 154 is smaller as shown in FIG. 13. Conversely, the quantity of fuel per unit time is increased when the oblong slot 154 of the quantity control valve 152 substantially coincides with the injection hole 153 as shown in FIG. 14. Thus, it is possible to control the quantity of fuel per unit time by this kind of rotation type quantity control valve 152.

In the above-mentioned embodiment or the modifications of the embodiment, various types of actuators will be used instead of the actuator 126 which is made of a stepping motor. Also, fuel may be used as a driving liquid of the actuator. Furthermore, the nozzle needle 133 or the push rod 137 may be driven directly by the actuator 127 to regulate the supply of the fuel, instead of indirectly controlling the valve 147 by the timing control actuator 127. Still further, the oblong slot 154 and the feeding slot 155 may be replaced by openings or holes. Moreover, the number of injection holes 153 may be controlled by the quantity control valve to regulate the effective area when the injector 114 has many injection holes 153.

Figure 15:
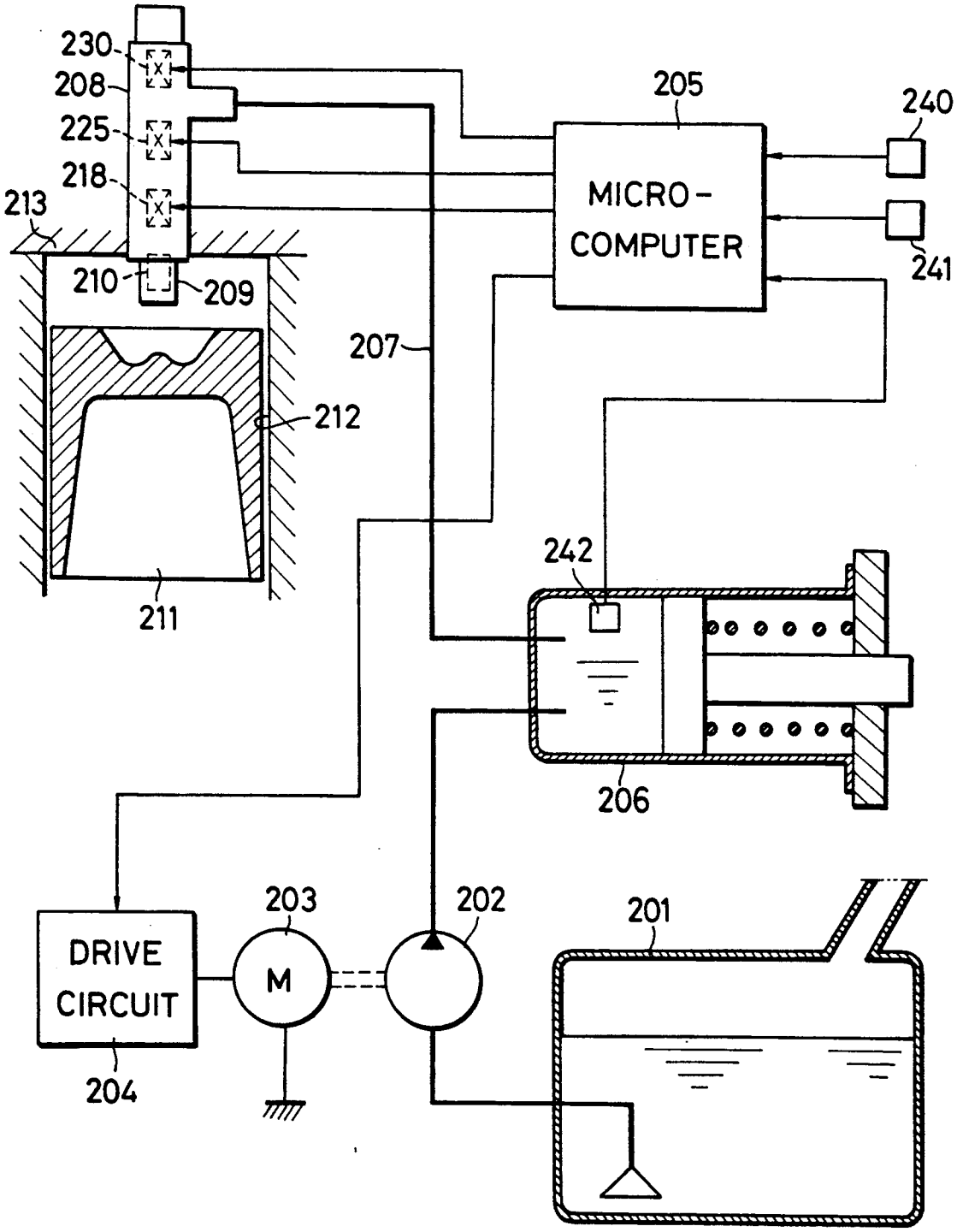
FIG. 15 is a block diagram of the fuel injection apparatus according to the second embodiment of this invention.

Next, will be described the second embodiment of this invention. FIG. 15 shows an overall composition of this embodiment which includes a fuel tank 201. The fuel in the tank 201 is sucked by a high pressure feed pump 202. The pump 202 is driven by a direct current motor 203 and the motor 203 is controlled by a microcomputer 205 through a drive circuit 204. The fuel pressed by a high pressure feed pump 202 is pushed into and stored in an accumulator 206.

The accumulator 206 is connected to an injector 208 by means of a feed pipe 207. An injection nozzle 209 is provided at the end of the injector 208 and has a quantity control valve 210. The quantity control valve 210 is controlled by a control signal from the microcomputer 205. The injector 208 is provided on a cylinder head 213 which is fixed at the top of the cylinder 212 which receives slidably a piston 211.

Figure 16:
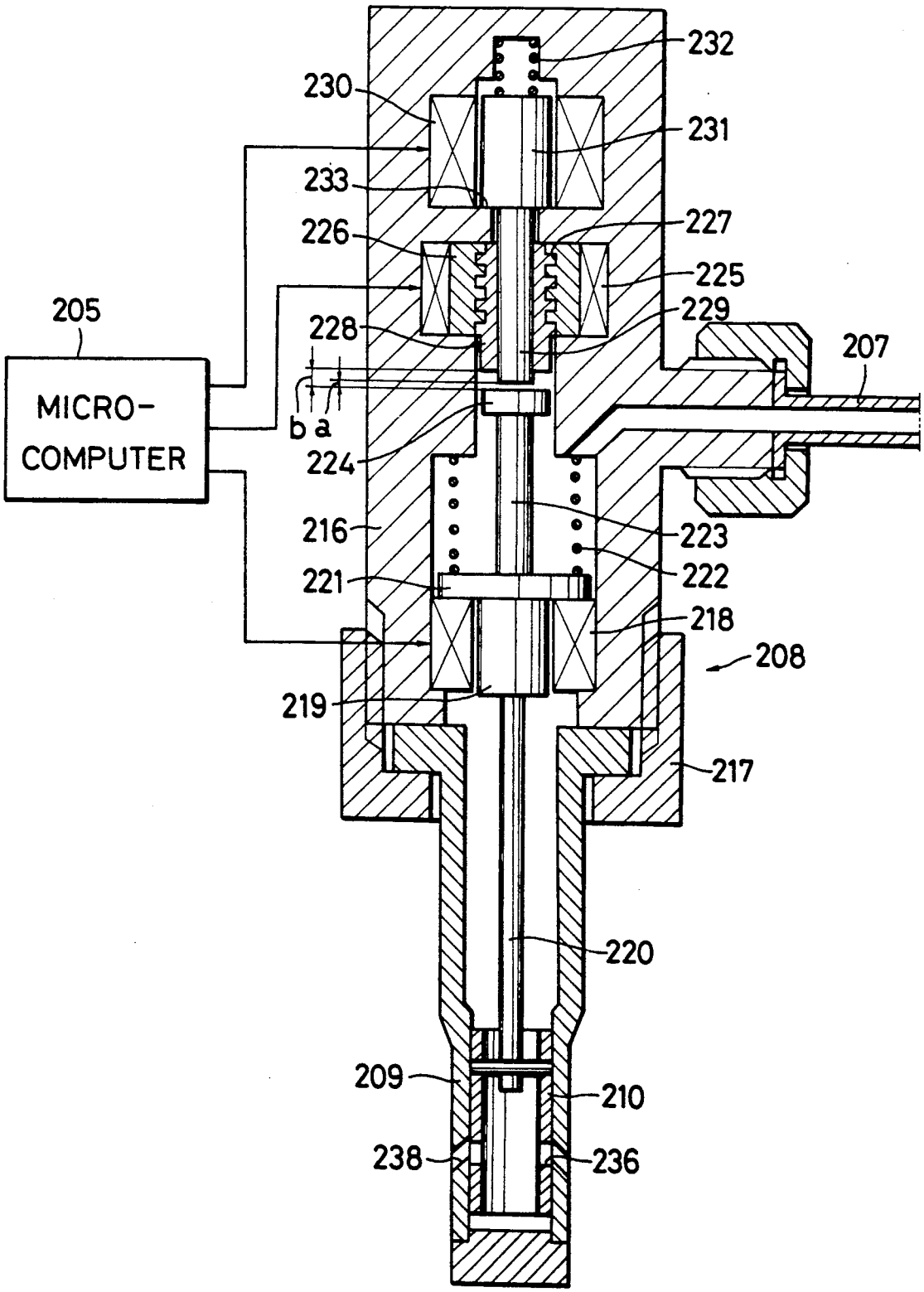
FIG. 16 is a cross section of the injector according to this embodiment.

The construction of the injector 208 is shown in FIG. 16. The injector 208 is comprised of a nozzle holder 216 which holds injection nozzle 209 by means of a retainer 217. A solenoid coil 218 is provided in the nozzle holder 216. A plunger 219 is connected to a quantity control valve 210 by a connecting rod 220. A spring seat 221 is provided at the top of the plunger 219 and receives a coil spring 222. The spring seat 221 has a rod 223 projecting upward therefrom and an abutting plate 224 is connected to the top of the rod 223.

A stepping motor 225 is arranged in the nozzle holder 216. A rotor 226 of the stepping motor 225 has a center hole 227 with a female thread. The female thread of the through hole 227 is engaged with a male thread formed on a periphery of the sleeve 228. A stopper rod 229 is situated so that the rod 229 goes through the sleeve 228. The rod 229 is connected to a plunger 231 situated at the center of a solenoid coil 230. The plunger 231 is pushed downward by a coil spring 232 and hence the bottom end of the plunger 231 engages with a step 233 of the nozzle holder 216.

Figure 17:
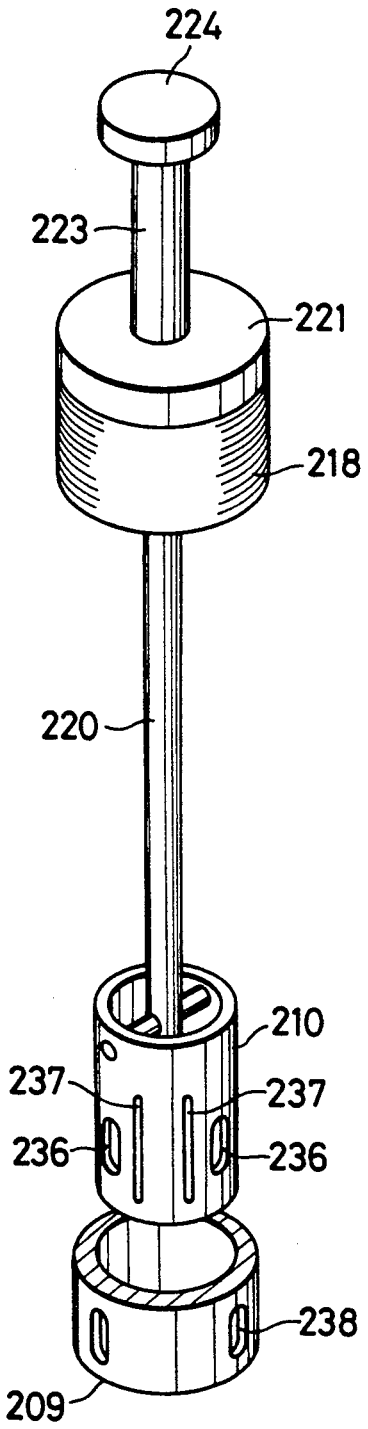
FIG. 17 is a perspective view of the quantity control valve of this injector.
Figure 18:
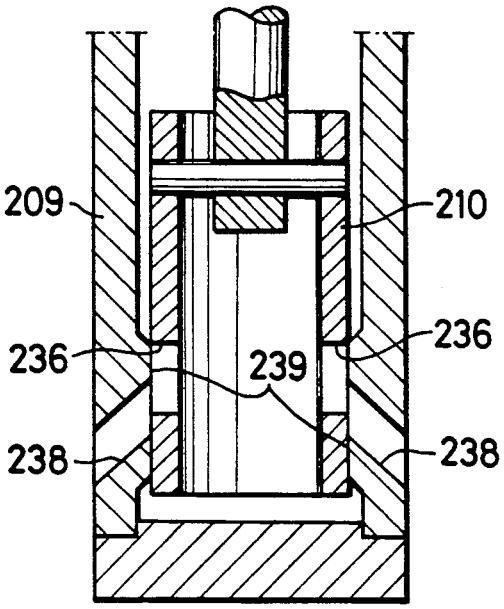
FIG. 18 is a cross section of the quantity control valve of the injector.
Figure 19:
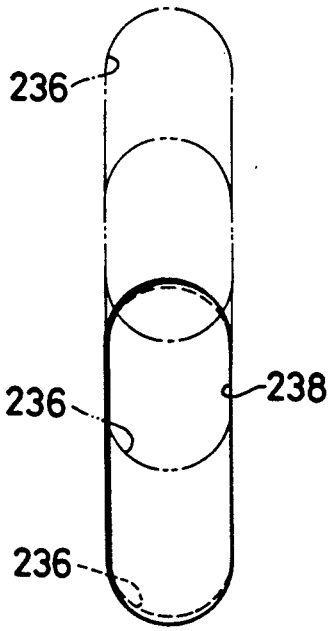
FIG. 19 is a front view of a control opening formed on the quantity control valve.

The injection nozzle 209 has a quantity control valve 210 which is made of a cylinder, as shown in FIG. 17 and FIG. 18, and the valve 210 has control openings 236 which extend axially. Slits 237 are formed at the both sides of the oblong openings 236. The valve 210 is received inside the injection nozzle 209 so that the control opening 236 coincides with the injection hole 238 of the injection nozzle 209. On the internal peripheral surface of the injection nozzle 209, valve seats 239 are located at the edge of the injection hole 238 and the quantity control valve 210 slides on the valve seat 239.

Figure 20:
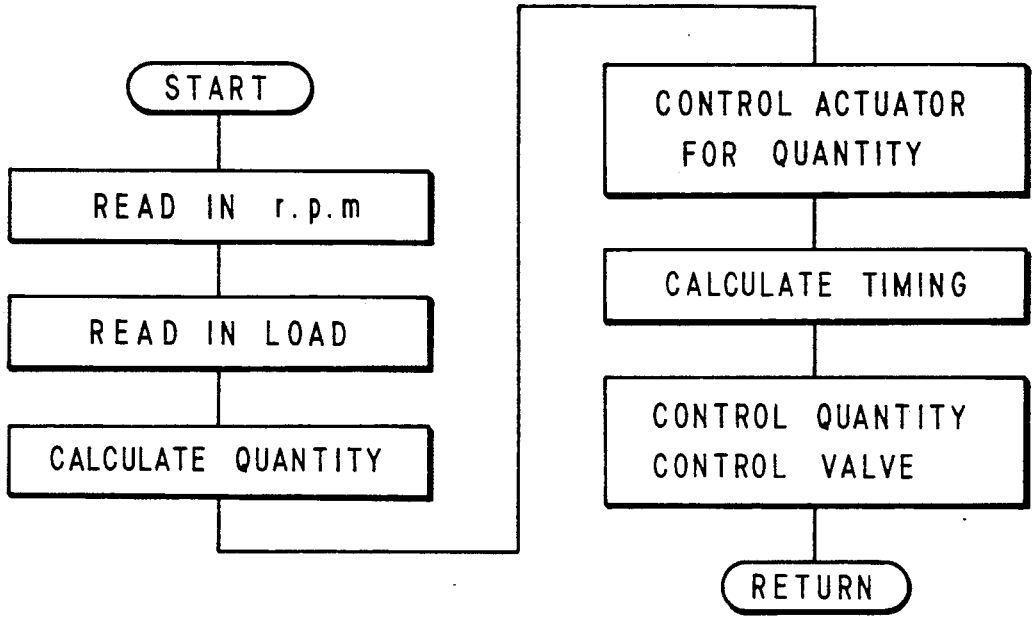
FIG. 20 is a flow chart of the operation of this injection apparatus.

On operation, the microcomputer 205 reads in the number of revolutions and the angular position of the engine through the revolution detecting sensor 240 and also reads in the load of engine through load sensor 241. Furthermore, the microcomputer 205 detects the pressure of the fuel in the accumulator 206 through the pressure sensor 242. The microcomputer 205 controls the motor 203 through the drive circuit 204 in order to maintain the pressure of fuel in the suitable value. The microcomputer 205 controls the solenoid coils 218, 230 and the stepping motor 225 in accordance with the flow chart shown in FIG. 20 and gives the control valve 210 a stepping displacement, to thereby control the quantity of fuel injected at one time and also to open and close the injection hole 238 of the injection nozzle 209.

Thus, the microcomputer 205 detects the number of revolutions and load of the engine through the revolution detecting sensor 240 and the load sensor 241, and based on these informations the microcomputer 205 calculates the quantity of fuel injected at one time. This quantity corresponds to the height b in the injection pattern shown in FIG. 21. To obtain the calculated quantity, the microcomputer 205 drives the stepping motor 225 which rotates the rotor 226 to a predetermined angular position. Then the sleeve 228 moves axially because the male thread of the sleeve 228 engages with the female thread 227 of the rotor 226. Therefore the gap b between the bottom end of the sleeve 228 and the top surface of the abutting plate 224 is regulated, and the stepping motor 225 is controlled.

Then the microcomputer 205 calculates the timing of the injection, and moves the valve 210 at the proper moment so that the control opening 236 and the injection hole 238 coincide. This operation starts fuel injection. That is, the microcomputer 205 energizes the solenoid coil 218 at the proper time. Then the plunger 219 moves upward against the coil spring 222 and the abutting plate 224 provided at the top of the rod 223 contacts with the stopper rod 229.

Accordingly, the control valve 210 moves upwards in the stroke corresponding to the gap a between the abutting plate 224 and the stopper rod 229. Thus, the injection hole 238 is slightly opened. Hence it is possible to decrease the quantity of fuel at the initial period of the injection, and a pilot injection is accomplished by this operation. When the stopper rod 229 which is connected to the plunger 231 is made of piezo electric material, the length of the rod 229 may be expandable to regulate the gap for controlling the quantity of fuel at the initial period of injection.

After the predetermined time duration from the start of the injection, the microcomputer 205 changes the fuel injection from pilot injection to main injection. That is, the microcomputer 205 energizes the solenoid coil 230 to displace upwardly the plunger 231 against the coil spring 232. Then the stopper rod 229 connected to the plunger 231 moves upward and is drawn inside the sleeve 228. Then the plunger 219 moves upwards until the abutting plate 224 comes in contact with the bottom end of the sleeve 228 because the plunger 219 is urged by the solenoid coil 218. As a result the quantity control valve 210 moves upwards with stepping displacement.

Accordingly, the quantity control valve 210 moves upwards in the stroke b, thereby making the injection hole 238 wide open. Since the effective area of the injection hole 238 is proportionate to the stroke of the quantity control valve 210, the quantity of fuel injected is controlled by the quantity control valve 210. After the predetermined time has passed, the solenoid coils 218 and 230 are deenergized and the quantity control valve 210 is pushed downward by the coil spring 222. The quantity control valve 210 moves downward to a position where the control hole 236 does not coincide with the injection hole 238 for closing the injection hole 238. In this way, the fuel injection is terminated.

Figure 21:
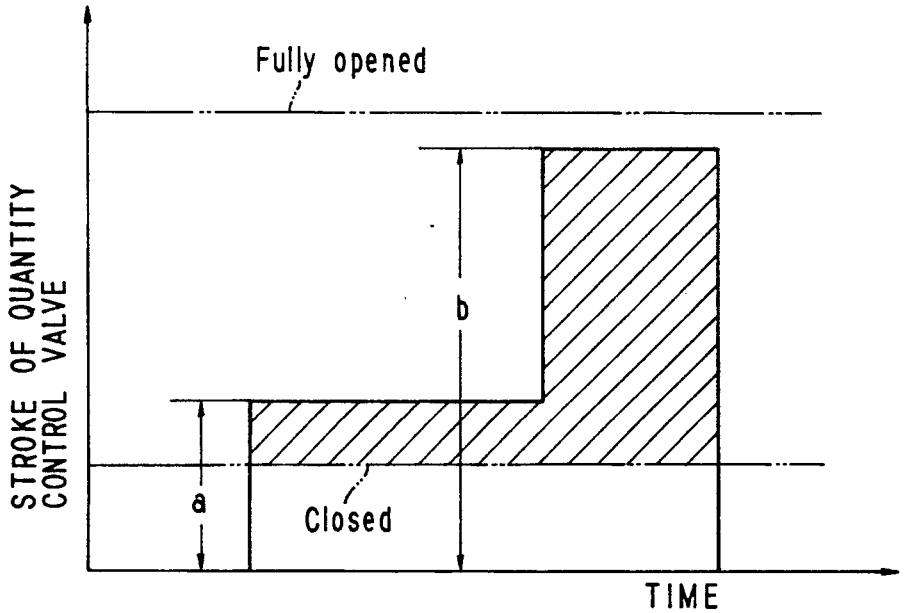
FIG. 21 is a diagram of the injection pattern of the fuel injection apparatus according to this embodiment.

The fuel injection apparatus of this embodiment does not require the use of a fuel injection pump, a mechanical governor or a mechanical timer. Furthermore, according to this embodiment it is possible to control the apparatus by the microcomputer 205, and ensure that a suitable quantity of fuel is injected at the proper time. Additionally, according to this arrangement, as injection pattern shown in FIG. 21 is accomplished and it is possible to decrease the quantity of fuel at the initial period of the injection. Therefore, it becomes possible to decrease the noise of the engine and to decrease the quantity of nitrogen oxide in the exhaust gas.

Figure 22:
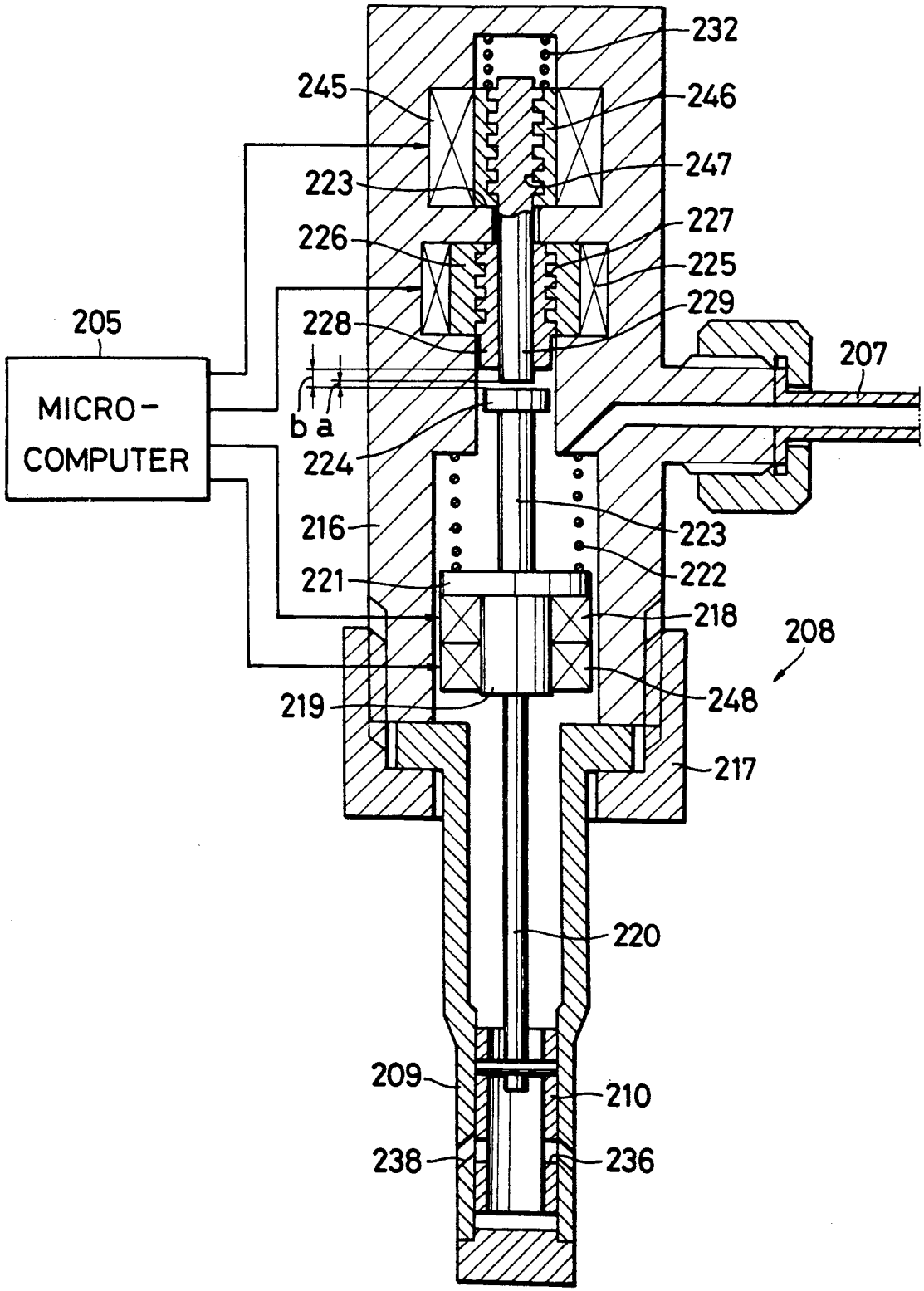
FIG. 22 is a cross section of an injector of the modified embodiment.

Next, a modification of the second embodiment will be described with reference to FIG. 22. The feature of this modification is that the injector 208 includes another stepping motor 245. A rotor 246 of the stepping motor 245 has a center hole 247 and the center hole is threaded with a female screw which is engaged with a male screw of the stopper rod 229. Additionally, another solenoid coil 248 is provided under the solenoid coil 218.

On operation, the stepping motor 225 regulates the gap b for controlling the quantity of the fuel of main injection. Another stepping motor 245 regulates the gap a for controlling the quantity of fuel in the pilot injection. At the proper moment the solenoid coil 218 is energized to displace the plunger 219 to a position where the abutting plate 224 contacts with the stopper rod 229 by the force of the coil 218. The injection hole 238 is then slightly opened by the control opening 236 of the valve 210 to accomplish the pilot injection.

After the predetermined time has passed the second solenoid coil 248 is energized, and the upward force is increased. As a result, the sleeve 246 of the stepping motor 245 which holds the stopper rod 229 moves upward against the coil spring 232 and the abutting plate 224 contacts with the bottom end of the sleeve 228 to displace the quantity control valve 210. In this way the injection hole 238 is opened wide to accomplish the main injection of fuel. The quantity of fuel is increased at this moment and the stepping pattern shown in FIG. 21 is accomplished as the above-mentioned second embodiment. Furthermore, by this modification it is possible to control the quantity of fuel of the pilot injection by the second stepping motor 245.

Figure 24:
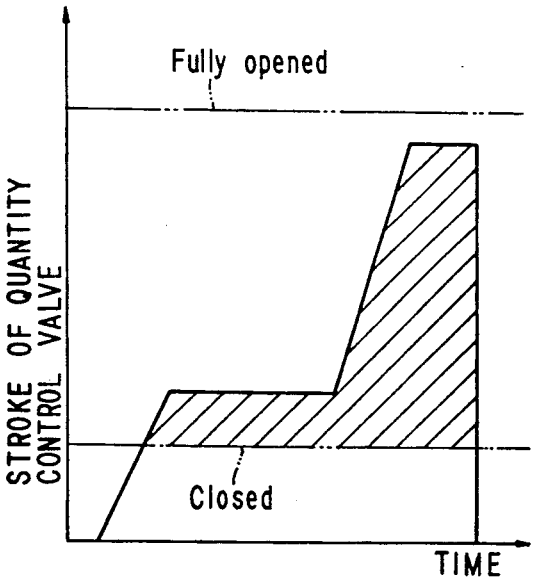
FIG. 24 is a fuel injection pattern according to the modified injector.
Figure 23:
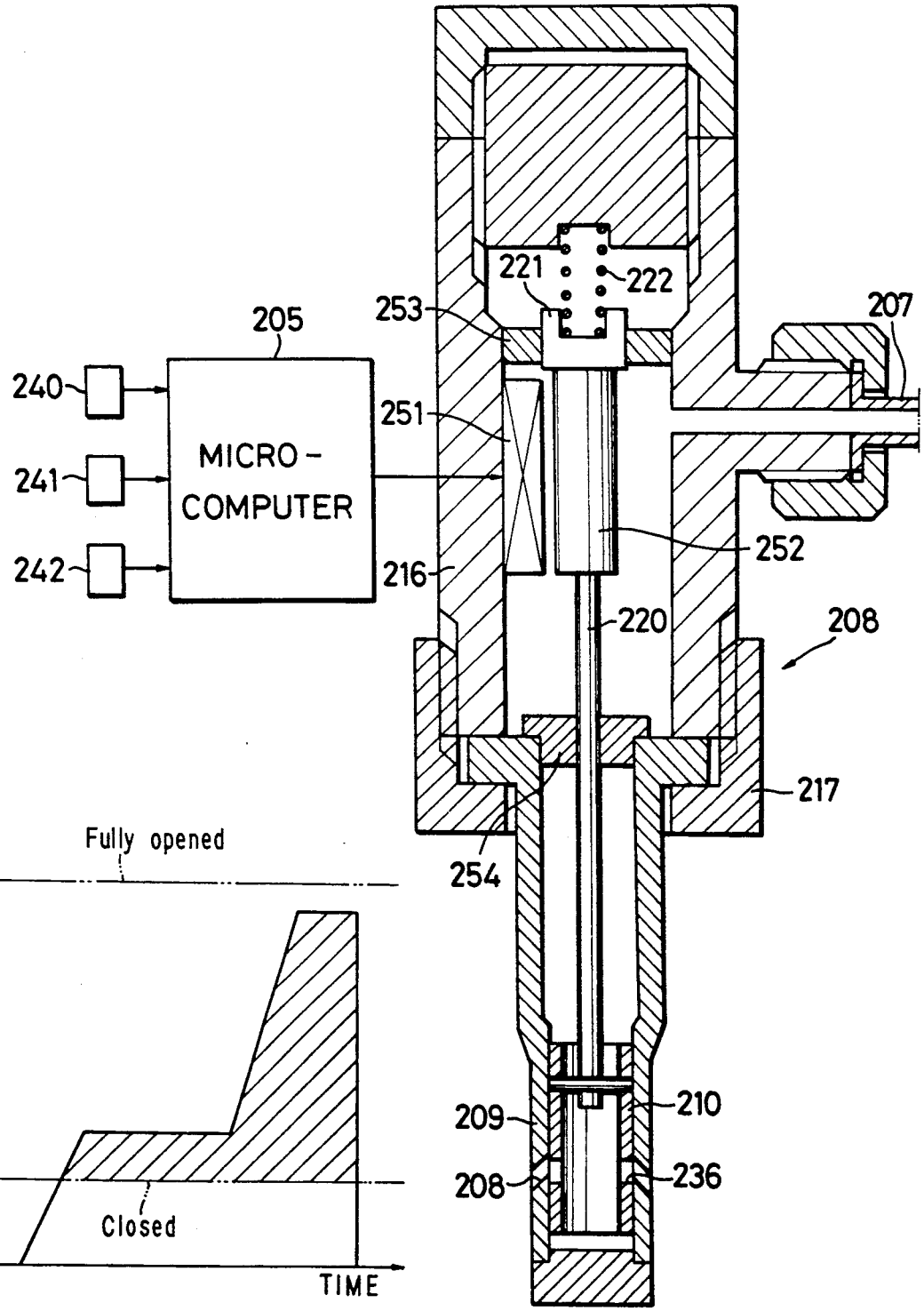
FIG. 23 is a cross section of the injector according to another modification.

Another modification of the second embodiment is shown in FIG. 23 and FIG. 24. The feature of this modification is that a linear stepping motor is used for the axial displacement of the quantity control valve 210. The slider 252 of the motor 251 is connected to the quantity control valve 210 by the connecting rod 220. A pair of guide members 253 and 254 are provided to ensure a smooth displacement of the slider 252. The microcomputer 205 controls the linear stepping motor 251 for displacing the quantity control valve 210 resulting in the fuel injection pattern shown in FIG. 24.

According to this arrangement, a singular linear stepping motor 251 moves the quantity control valve 210 steppingly and hence it is possible to simplify the structure of the injector and minimize the number of the actuator 251. Furthermore, it is possible to omit the coil spring 222 when the return motion of the quantity control valve is also accomplished by the linear stepping motor 251. By this arrangement structure is more simplified.

Figures 25, 26:
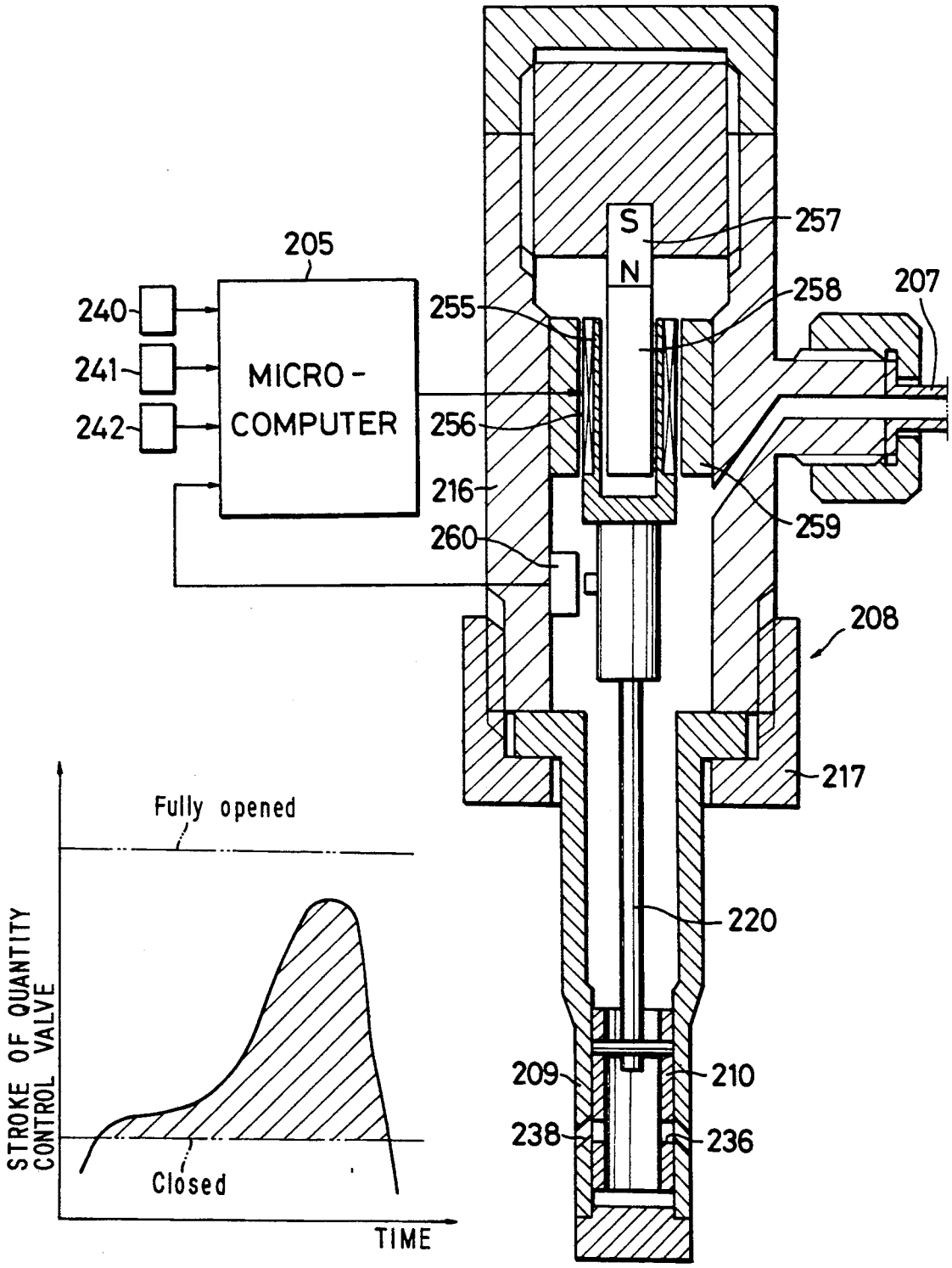
FIG. 25 is a cross section of the injector according to another modification.
FIG. 26 is a fuel injection pattern according to the injector of FIG. 25.

Next, another modification will be described with reference to FIG. 25 and FIG. 26. In this modification, a moving coil 256 wound on a bobbin 255 is used for moving the quantity control valve 210. That is, the moving coil 256 constitutes the actuator for control valve 210. The moving coil 256 wound on the bobbin 255 is connected to the control valve 210 by the connecting rod 220. The moving coil 256 is located between a center pole 258 which is mounted at the top of a magnet 257 and an outside yoke 259. Upward or downward force is applied to the moving coil 256 by the principle of the voice coil of a dynamic speaker. The quantity control valve 210 is moved by this force. A position detecting sensor 260 is provided for holding the quantity control valve 210 at a predetermined position. That is, the position detecting sensor 260 detects the position of the valve 210 and supplies the signal to the microcomputer 205 for controlling the moving coil 256. Namely, a feed back control is accomplished by the position detecting sensor 260. Accordingly, it is possible to simplify the structure of the actuator and also it is possible to control the injection pattern voluntarily and precisely as shown in FIG. 26 to accomplish an ideal combustion of fuel.

Figure 27:
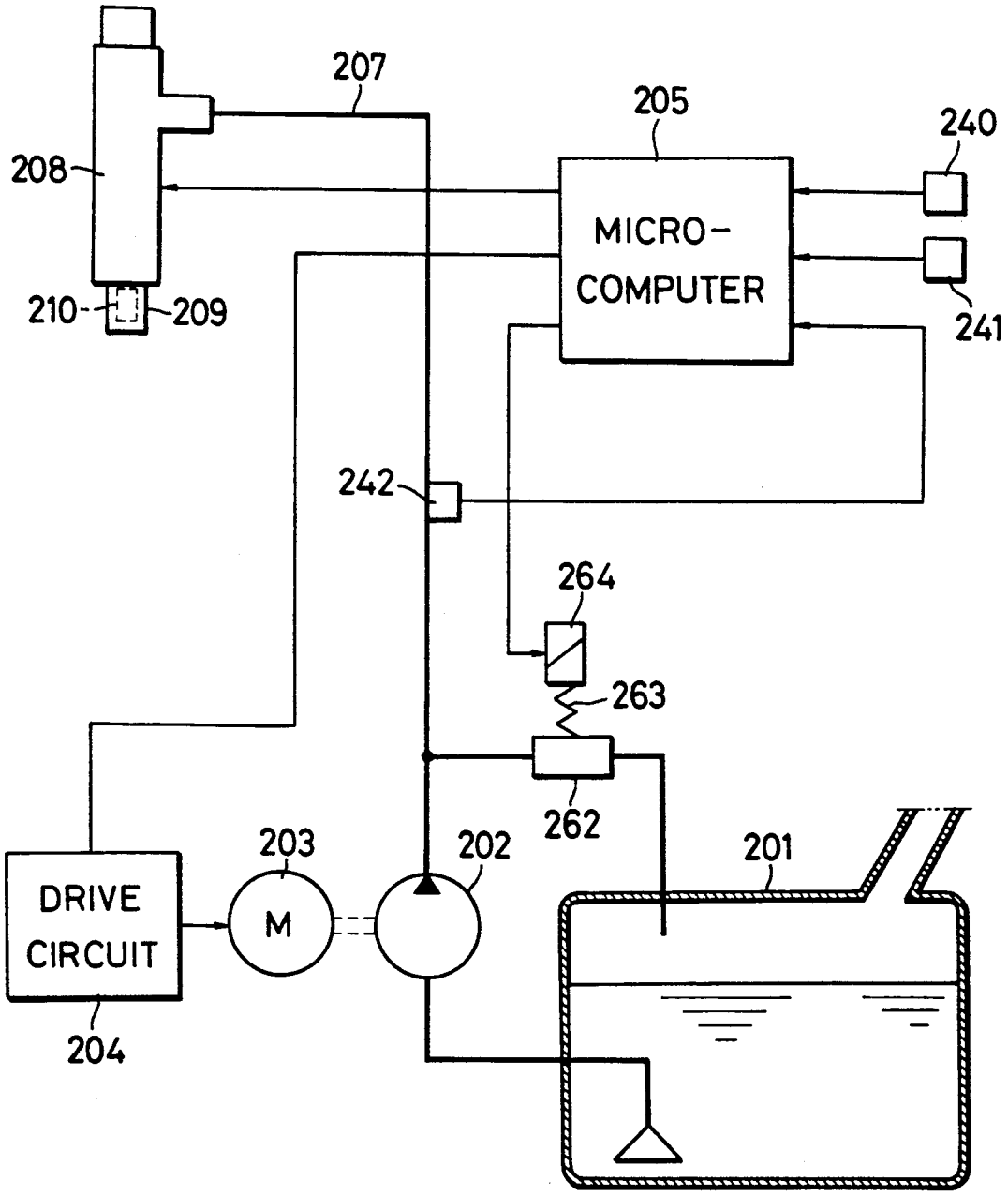
FIG. 27 is a block diagram of a modified fuel injection apparatus.
Figure 28:
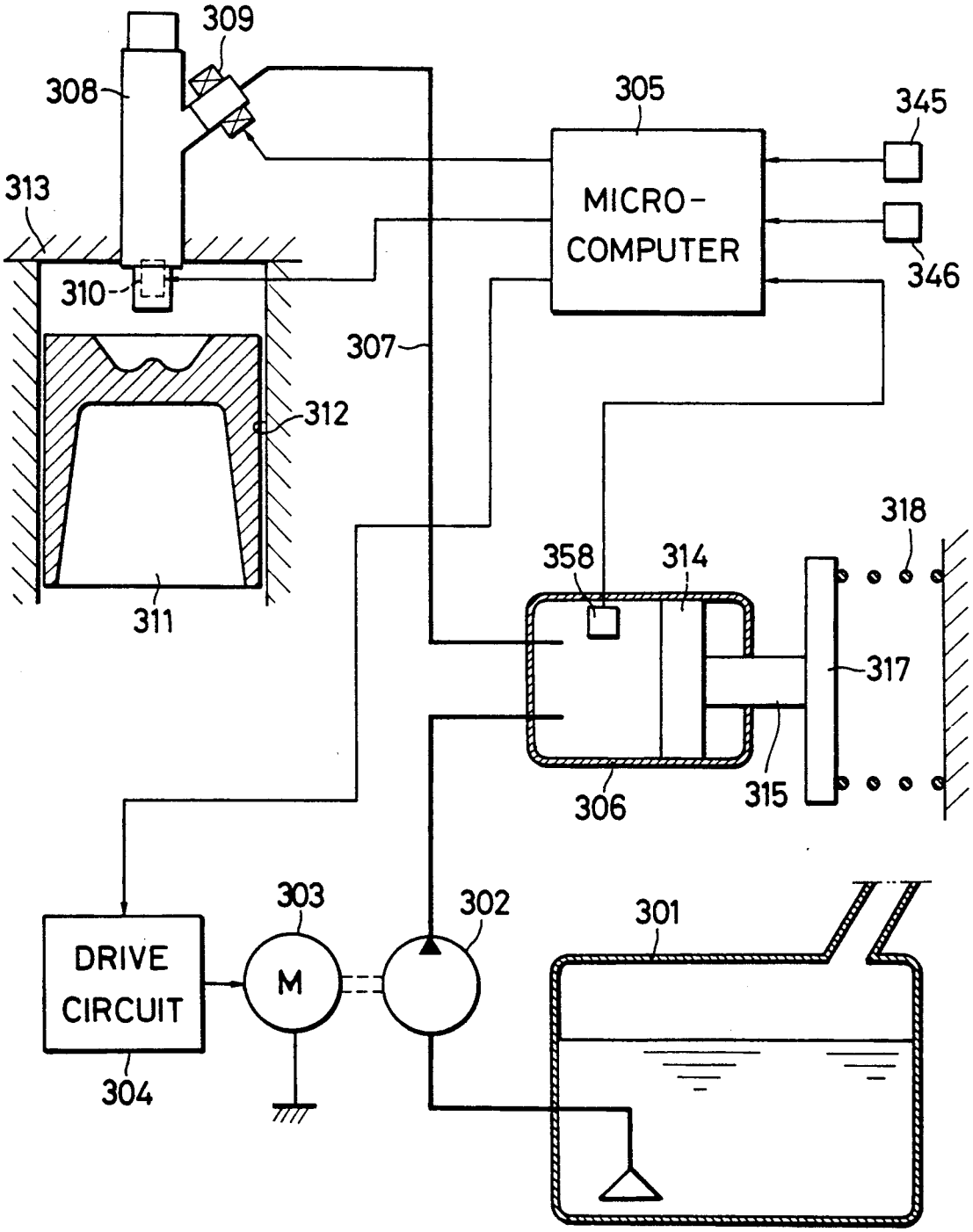
FIG. 28 is a block diagram of a fuel injection apparatus according to the third embodiment of this invention.

FIG. 27 shows still further modification of the second embodiment. The feature of this modification is that a relief valve 262 is provided for omitting the accumulator. The relief valve 262 is connected to the fuel feed pipe 207. A spring 263 of the valve 262 is controlled by the microcomputer 205 through an actuator 264 for controlling the relief pressure of the relief valve 262. The microcomputer 205 regulates the spring 263 through the actuator 264 in response to the pressure detecting sensor 242 to precisely control the pressure on which the relief valve 262 operates. Accordingly, it is possible to control the output pressure of the fuel feed pump 202 and to accomplish the fuel injection without an accumulator.

Next, a third embodiment of this invention will be described with reference to FIG. 28 to FIG. 32. The injection apparatus of this embodiment has a fuel tank 301, from which fuel is sucked by a high pressure feed pump 302. The pump 302 is driven by a direct current motor 303 and the motor 303 is controlled by a microcomputer 305 through a drive circuit 304. The fuel pumped by the feed pump 302 is pushed into and stored in an accumulator 306.

The accumulator 306 is connected to an injector 308 by a fuel feed pipe 307. The fuel injector 308 has a timing valve 309 and a quantity control valve 310, both of which are controlled by the microcomputer 305. The injector 308 is held by a cylinder head 313 which is fixed at the top of the cylinder 312, and the cylinder 312 supports a piston 311 slidably therein.

Figure 29:
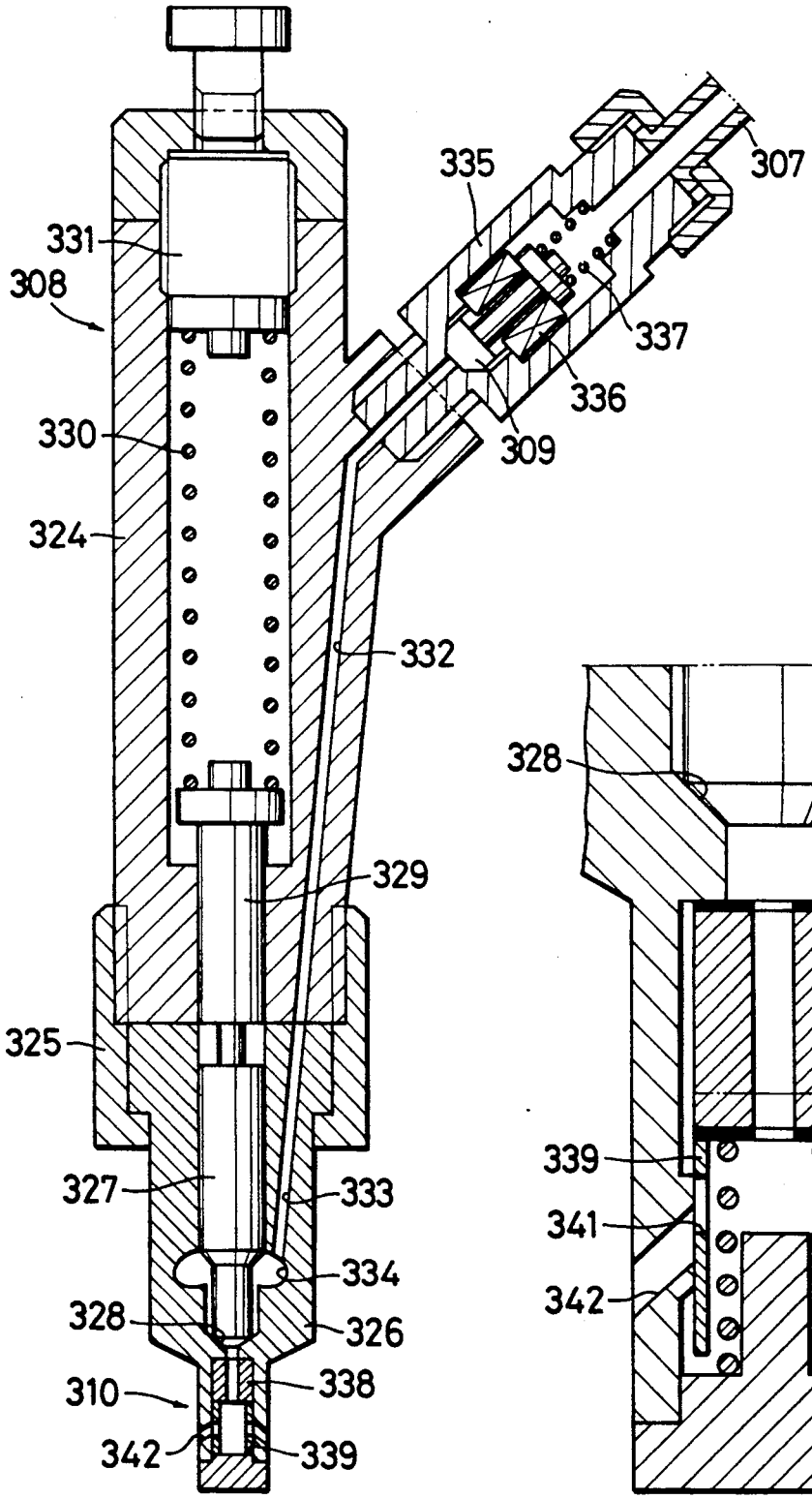
FIG. 29 is a cross section of the injector according to this embodiment.

As shown in FIG. 29 the fuel injector 308 is comprised of a nozzle holder 324 which holds a nozzle 326 by means of a retainer 325. A nozzle needle 327 is slidably received in the nozzle 326, and the top of the nozzle needle 327 contacts with a conical valve seat 328 to control the injection of the fuel. Additionally, the top of the nozzle needle 327 contacts with a push rod 329, and the push rod 329 is urged by a coil spring 330. The top end of the spring 330 is received by a spring seat 331 which is held by the nozzle holder 324 by a screw.

Still further, passages 332 and 333 are formed on the nozzle holder 324 and the nozzle body 326 respectively. The passage 333 of the nozzle 326 communicates with a reservoir 334. Fuel passage 332 of the nozzle holder 324 communicates with a connecting sleeve 335. The sleeve 335 holds the timing valve 309 slidably and a solenoid coil 336 which controls the timing valve 309. The coil 336 moves the valve member 309 against the resilient force of a return spring 337.

Figure 30:
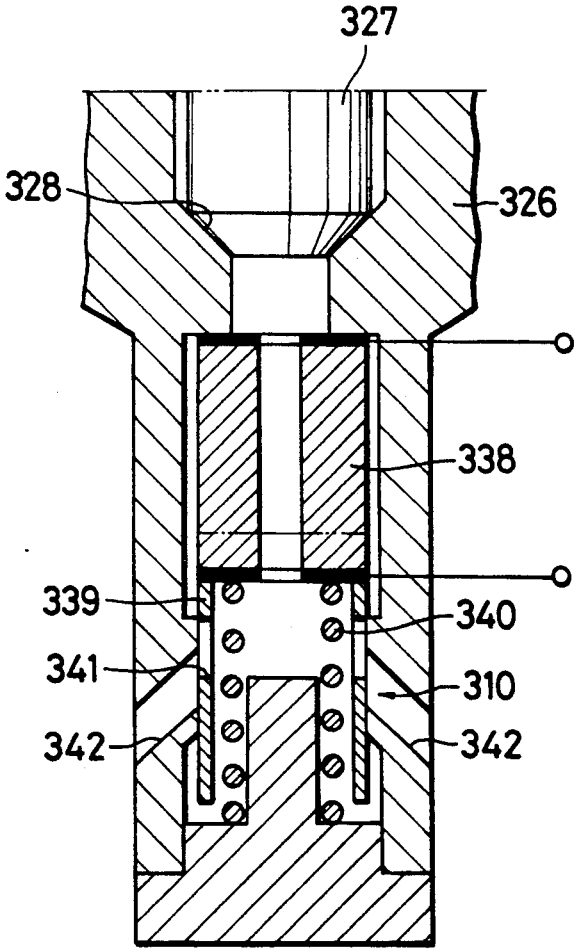
FIG. 30 is an enlarged cross section of the injector.
Figure 31:
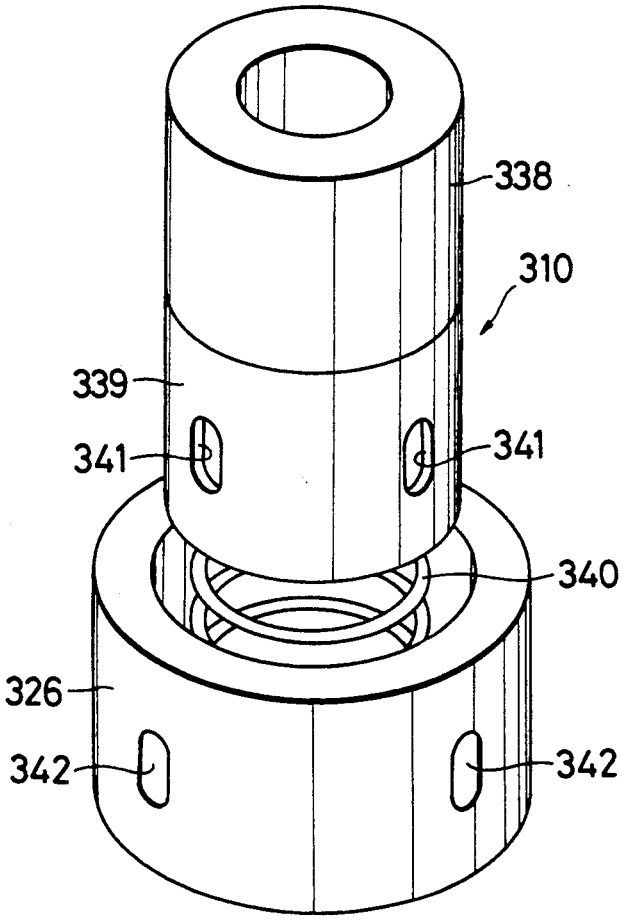
FIG. 31 is a perspective view of the quantity control valve.

A quantity control mechanism is provided at the top of the nozzle 326 as shown in FIGS. 30 and 31. The mechanism includes a cylindrical peizo-electric element 338 which is held at the top of the nozzle 326. The cylindrical element 338 has a valve member 339. The element 338 is pushed upward by a coil spring 340 so that the valve member 339 contacts the step of the nozzle 326 and maintains the position. Control holes 341 are formed on the valve member 339. Injection hole 342 is located on the nozzle 326 to correspond with the control hole 341 of the valve member 339.

Accordingly, the valve member 339 moves axially in the nozzle 326 when electric voltage is applied on the piezo-electric element 338 and the voltage is changed. By this operation the effective area of the injection hole 342 is regulated by the control opening 341 of the valve member 339. When the valve member 339 moves downward, the effective area of the injection hole is increased and the quantity of the fuel injected per unit time is increased.

An operation of the apparatus according to this embodiment will be described. A microcomputer 305 reads in the revolutional number and the engine load through the revolution detecting sensor 345 and load sensor 346. The load sensor 346 detects the load of engine in response to the angular position of an accelator pedal. The microcomputer 305 calculates the timing of injection, quantity of fuel, and the injection pattern based on the above-mentioned informations. The microcomputer 305 then controls the timing valve 309 and the quantity control valve 310 in response to the calculation.

Figure 32:
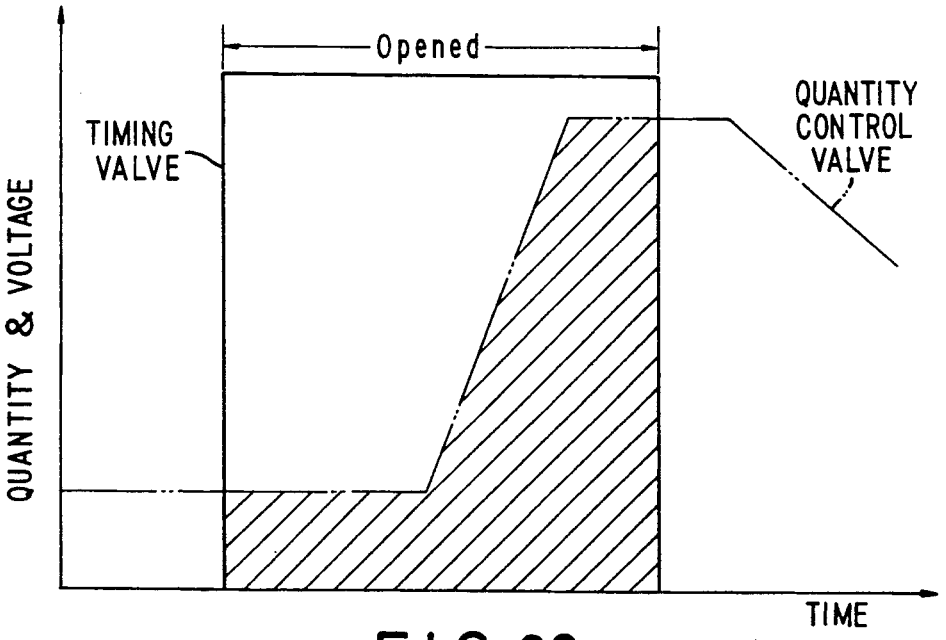
FIG. 32 is a diagram of the injection pattern according to this embodiment.

FIG. 32 shows one example of an injection pattern of this apparatus. An operation of the timing control valve 309 is shown a solid line and the operation of the quantity control valve 310 is shown by a chain line. Accordingly, a pile portion denoted by oblique lines shows an actual injection characteristic of this apparatus. The feature of this pattern is that the piezo-electric element 338 squeezes the area of the injection hole 342 by means of the valve member 339 for a predetermined time duration just after the time when the timing control valve 309 is opened, and this operation accomplishes the pilot injection. Thus, the quantity of fuel at the initial period of the injection is decreased. After the predetermined time has passed, the piezo-electric element 338 moves the valve member 339 to open the injection hole widely and the fuel injection is changed over to main injection. According to this injection pattern, it is possible to decrease the engine noise and the amount of nitrogen oxide in the exhaust gas.

Figure 33:
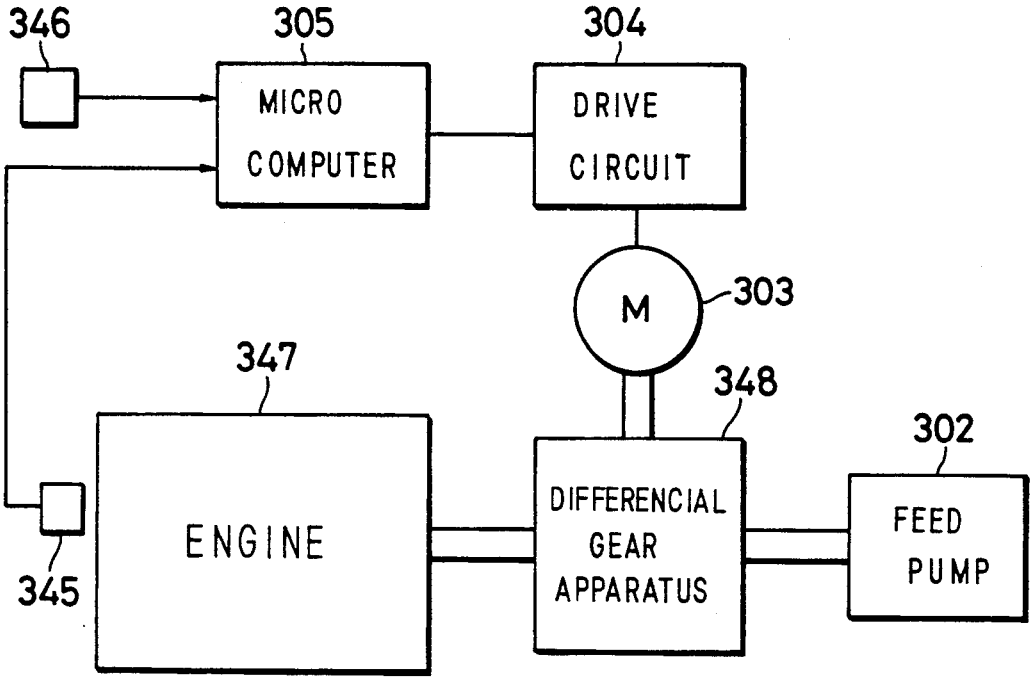
FIG. 33 is a block diagram of a modified pump drive system of this embodiment.
Figure 34:
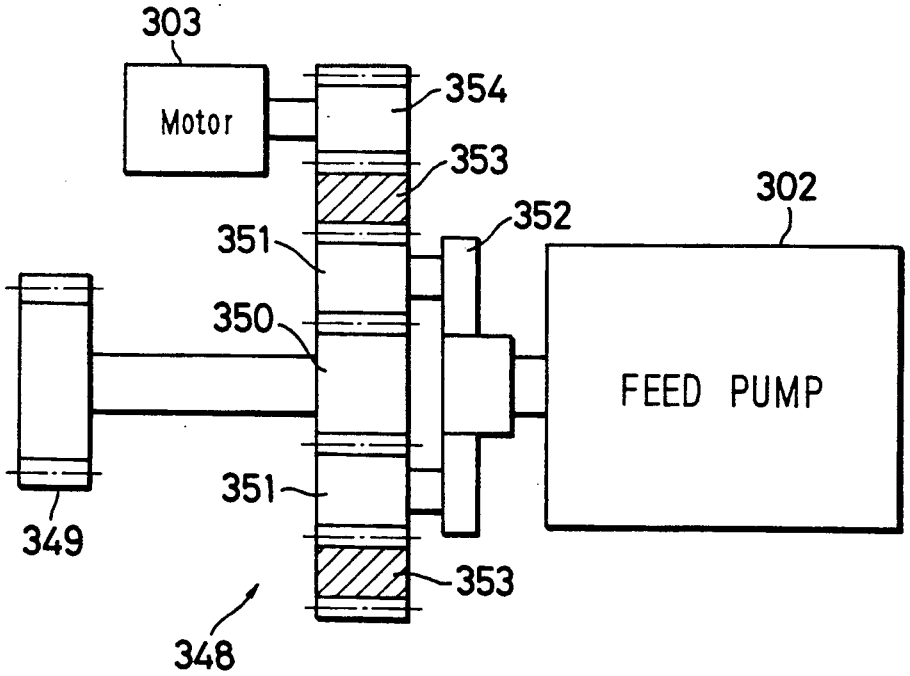
FIG. 34 is a gearing diagram of the modified embodiment.
Figure 35:
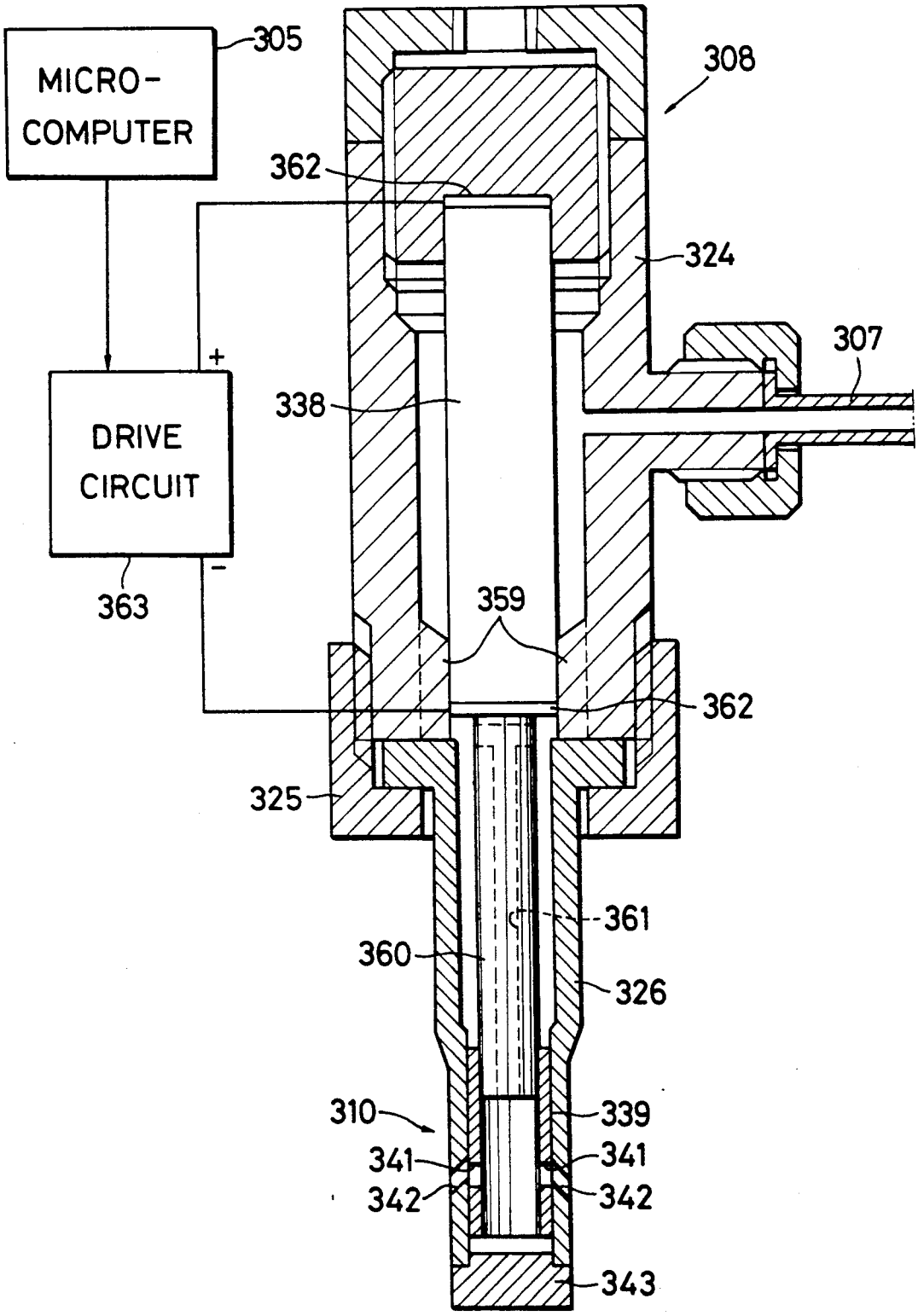
FIG. 35 is a cross section of a modified injector.

FIG. 33 and FIG. 34 show a modification of this embodiment. The feature of this modification is that a differential gear apparatus 348 is used for driving the high pressure feed pump 302, instead of the direct current motor 303. The differential gear apparatus 348 is combined with an engine 347 and the revolutional number of the output of the apparatus is controlled by the direct current motor 303.

More specifically, a gear 349 takes out the torque of the engine 347 as shown in FIG. 34 and the gear 349 is connected to a sun gear 350 which engages a planet gear 351. The planet gear 351 is supported by an arm 352. The arm 352 is fixed on the input shaft of the feed pump 302. The planet gear 351 supported by the arm 352 is engaged with an internal gear 353. The outside gear of the internal gear 353 is driven by a pinion 354 which is fixed on the output shaft of the motor 303.

Accordingly, the torque of the engine 347 transmitted to the gear 349 is transformed to a rotation of a pair of planet gears 351 by means of the sun gear 350. Therefore, the planet gears 351 makes the internal gear 353 revolve. The revolution is transmitted to the feed pump 302 by means of the arm 352. The motor 303 drives the internal gear 353 through the pinion 354. The revolutional speed of the arm 352 is increased when the motor 303 drives the internal gear 353 in the plus direction, and decreased when rotated in the minus direction. Furthermore, it is possible to stop the pump 302 by the motor 333. Therefore, it is possible to obtain torque from the engine 347 and control the number of revolutions of the feed pump 302 by the motor 303. The feed pump 302 may be made of plunger pump, vane pump, or the another kind of pump, and the feed pump may be made of a multistage pump to obtain the required output pressure.

Next, another modification of the embodiment will be described with reference to FIG. 35 to FIG. 39. The feature of this modification is that the quantity control valve 310 of the injector 308 constitutes not only the quantity control valve, but also the timing valve. That is, a column of piezo-electric element 338 is received in the nozzle holder 324 of the injector 308, and the bottom end of the column 338 is guided in the axial direction by a pair of projections 359 provided inside the nozzle holder 324. A cylindrical valve member 339 is connected to the piezo-electric element 338 by the connecting member 360 which has a feed hole 361 for feeding the fuel into the valve member 339. The piezo-electric element 338 has electrodes 362 which are connected to a drive circuit 363.

Figure 36:
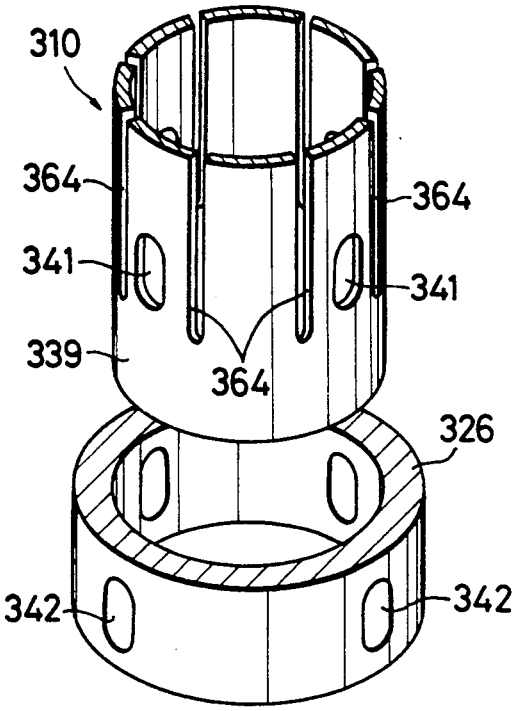
FIG. 36 is a perspective view of the quantity control valve.
Figure 37:
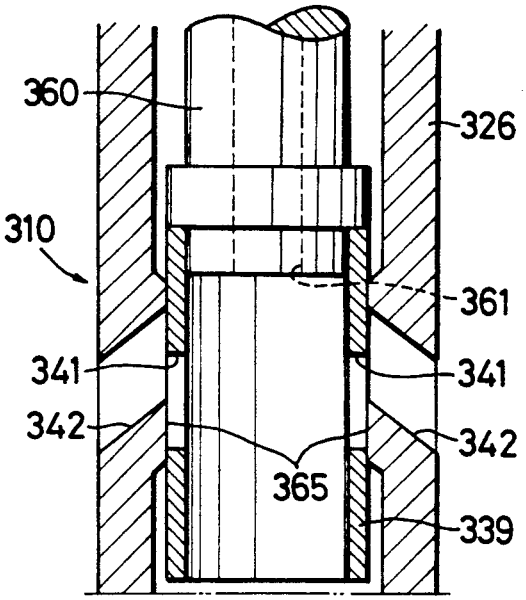
FIG. 37 is a cross section of the quantity control valve.

The valve member 339 has control openings 341 as shown in FIG. 36 and FIG. 37, and the control openings 341 control the effective area of the injection hole 342 of the nozzle 326. Furthermore, the longitudinal slots 364 are formed on the valve member 339. The slots 364 serve to deform the valve member 339 for contacting with the valve seat 365 by the pressure of the fuel.

Figure 38:
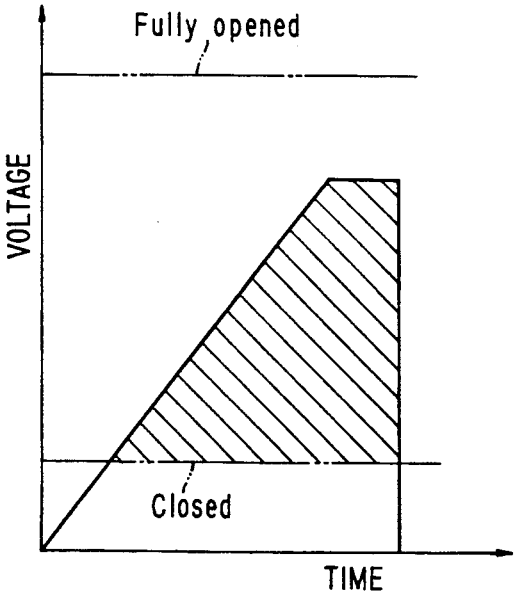
FIG. 38 is a diagram of an injection pattern of this modified embodiment.
Figure 39:
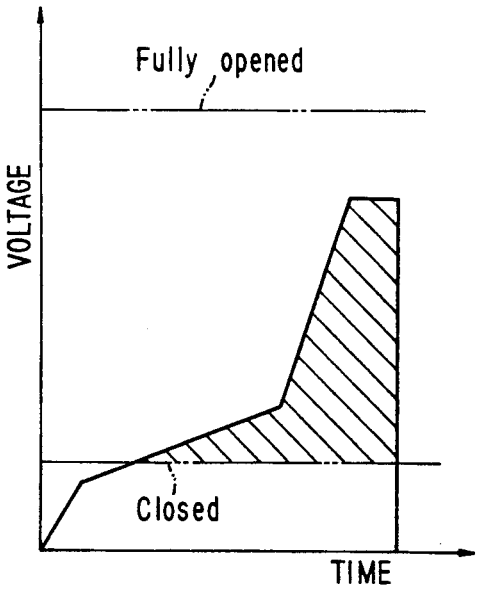
FIG. 39 is another diagram of an injection pattern of this modified embodiment.

On operation the microcomputer 305 supplies a control signal to the drive circuit 363 to generate a pattern of voltage for the piezo-electric element 338 as shown in FIG. 38 or FIG. 39. As the voltage applied on the piezo-electric element 338 is substantially proportional to the stroke of the valve member 339, the injection hole 342 is opened and the effective area of the injection hole 342 is controlled by the control opening 341 of the valve member 339. Specifically, it is possible to obtain an injection pattern of ideal or suitable combustion when the quantity of fuel at the initial period of the injection is decreased as shown in FIG. 39.

Furthermore, in this modification, the valve member 339 moves to such a position where the control opening 341 does not coincide with the injection hole 342 when the voltage is relieved. This operation makes it possible to omit the timing valve, because the valve member 339 performs not only the quantity control valve function but also the timing valve function. Also, it is not necessary to use a timing control valve made of a solenoid valve. Additionally the valve member 339 is pressed on the valve seat 365 of the nozzle 326 by the pressure of the fuel, and by this arrangement it is possible to close the injection hole securely. The closing operation is well aided by the slits 364 which serves to deform the valve member 339.

Figure 40:
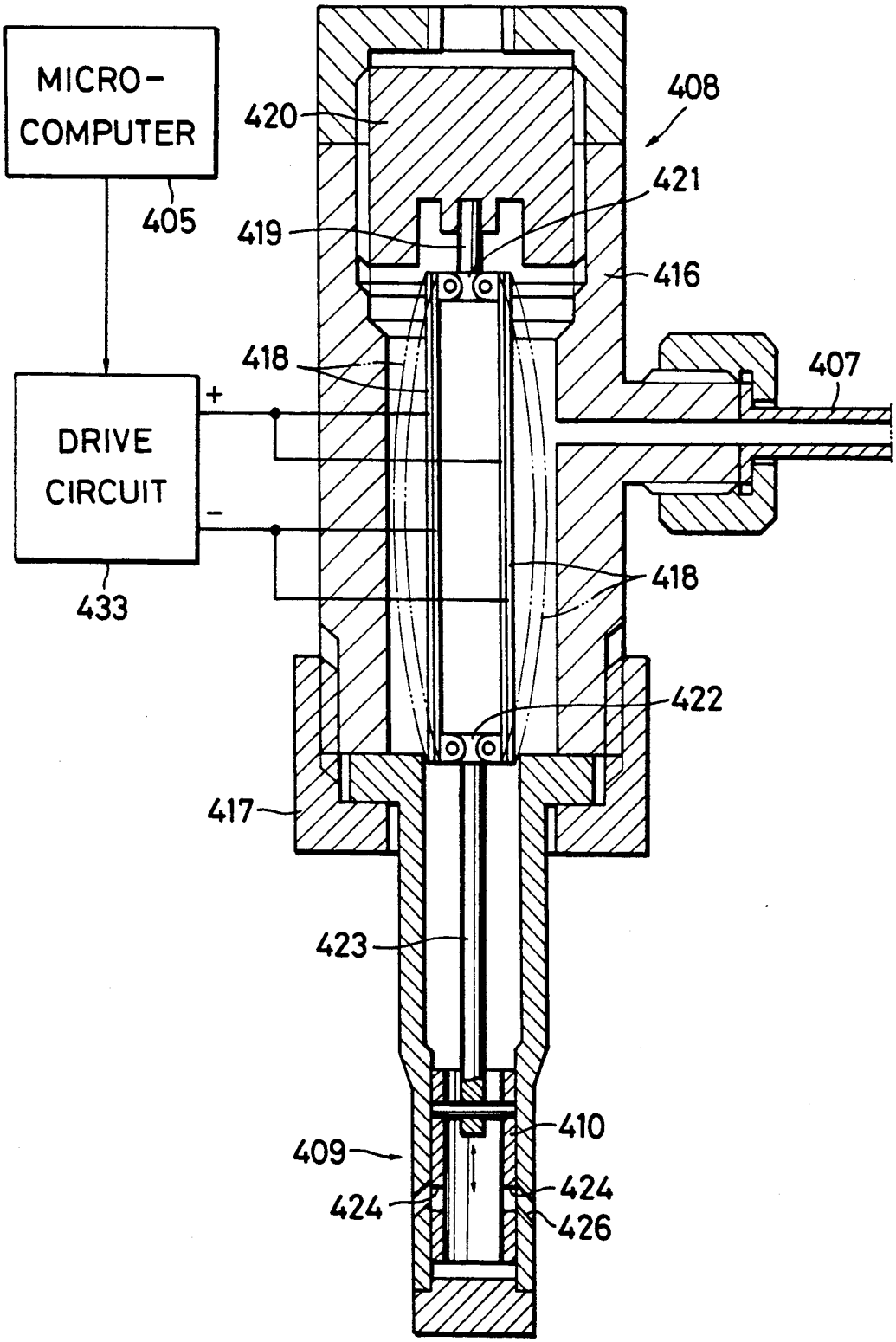
FIG. 40 is a cross section of an injector according to the fourth embodiment of this invention.

Next, will be described the fourth embodiment of this invention with reference to FIG. 40 to FIG. 43. FIG. 40 shows an injector 408 of this embodiment, which includes a nozzle holder 416. A nozzle 409 is connected to the bottom of the nozzle holder 416 by the retainer 417. A pair of bimorph plates are arranged parallel and longitudinally in the nozzle holder 416. A rod 419 is secured with an adjusting screw 420 and the rod 419 has a bracket 421 which supports the top ends of a pair of bimorph plates rotatably. The lower ends of a pair of bimorph plates 418 are connected rotatably to a bracket 422, and the bracket 422 is connected to the quantity control valve 410 by a connecting rod 423.

Figure 41:
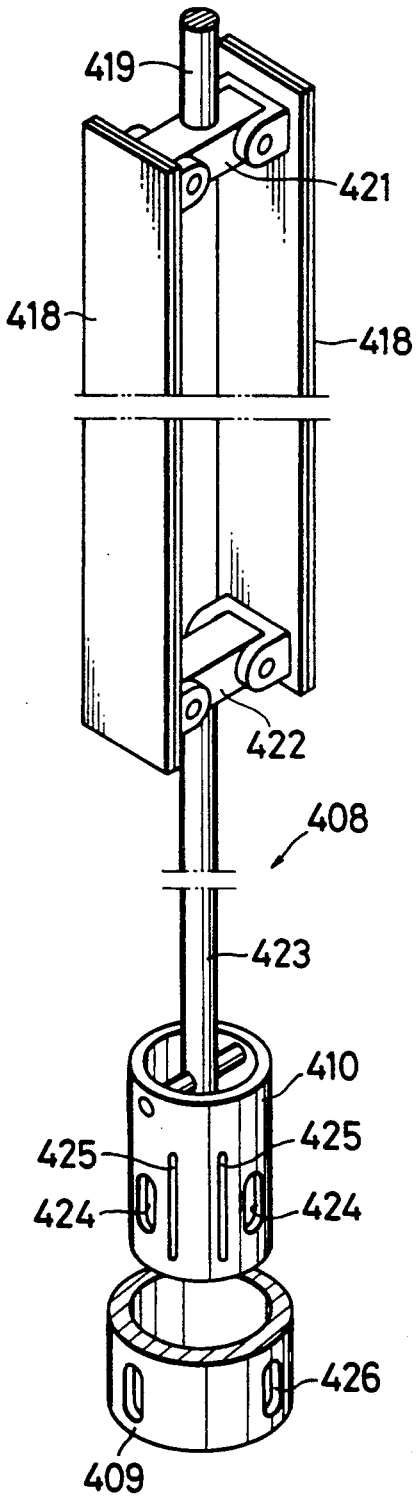
FIG. 41 is a perspective view of the quantity control valve of this embodiment.
Figure 42:
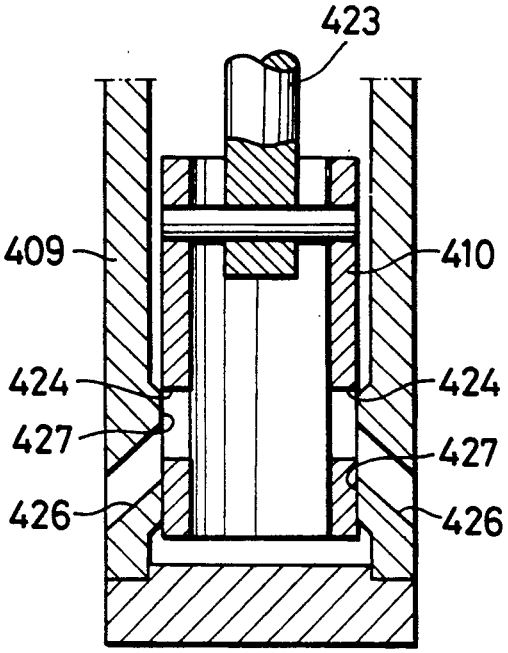
FIG. 42 is an enlarged cross section of the fuel control valve.

The quantity control valve 410 is cylindrical as shown in FIG. 41 and FIG. 42 and has control openings 424 or of oblong openings and longitudinal slots 425 at the both sides of the control openings 424. The quantity control valve 410 is arranged inside the nozzle 409 so that the control openings 424 coincides with the injection hole 426 of the nozzle 409. The valve member 410 slides axially on the valve seat 427 formed on the internal peripheral surface of the nozzle 409 with an injection hole 426.

On operation the microcomputer 405 reads in the revolutional number and the angular position of the engine through a revolution detecting sensor, and the engine load through a load sensor. The microcomputer 405 also reads in the pressure of the fuel held in the accumulator (not shown) by a pressure sensor. The microcomputer 405 then controls the pump, through the motor to maintain the pressure of the fuel in a suitable value. The microcomputer 405 also controls a pair of bimorph plates 418 for displacing the quantity control valve 410 to thereby control the quantity of fuel injected at one time. The control valve 410 opens and closes the injection hole 426 of the nozzle 409.

In summary, the microcomputer 405 reads in the revolutional number and the load of the engine, and then calculates the timing of the injection, the quantity of fuel, and the injection pattern based on the above-mentioned informations. Resulting with these calculations, the microcomputer 405 controls the drive circuit 433 which controls the voltage applied on the bimorph plates 418.

Figure 43:
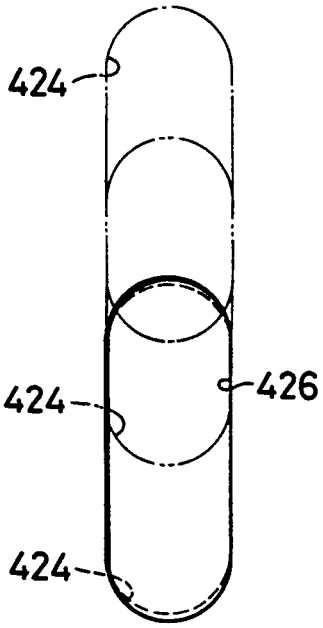
FIG. 43 is a front view of an oblong opening formed on the quantity control valve.

The bimorph plates 418 deform as shown by the chain line in FIG. 40 when electric voltage is applied. The pair of bimorph plates 418 deform in such a manner that intermediate portions of these plates 418 are separated from each other. As a result of this deformation the lower bracket 422 moves upward. This movement is transmitted to the quantity control valve 410 by the rod 423. Accordingly, as shown in FIG. 43 the control opening 424 controls the effective area of the injection hole 426, thus performing the quantity control operation.

In this apparatus the quantity control valve 410 has sufficient stroke to close the injection hole 426. Therefore, the quantity control valve 410 not only controls the quantity of fuel but also controls the opening and closing of the injection hole 426. Furthermore, the injection pattern is controlled when the voltage applied on the bimorph plate 418 is controlled. More specifically, when the quantity of fuel at the initial stage of the fuel injection is decreased, it is possible to decrease the engine noise and amount of nitrogen oxide in the exhaust gas.

As mentioned above, according to this embodiment, the control of fuel quantity, the injection timing, and the injection pattern are all accomplished by the quantity control valve 410 associated with a pair of bimorph plates 418. Furthermore, the control valve 410 is pressed against the valve seat 427 by the pressure of the fuel through the longitudinal slots 425 to accomplish perfect sealing operation when this quantity control valve 410 displace to the position where the injection hole 426 is closed.

Figure 44:
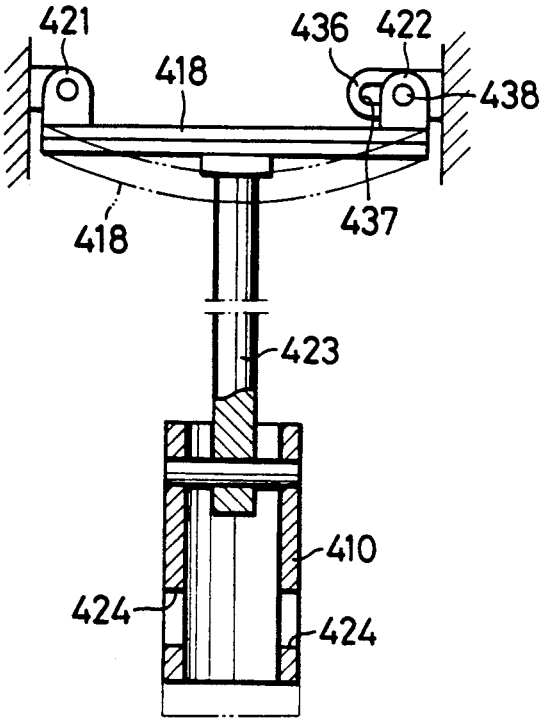
FIG. 44 is a front view of a modified actuator for the quantity control valve.

Next, a modification of the fourth embodiment will be described with reference to FIG. 44 which shows a single bimorph plate 418 for displacing the quantity control valve 410. The bimorph plate 418 is disposed horizontally. One end of the plate 418 has a bracket 422 which is connected to an oblong opening 437 of a supporting bracket 436 by means of a pin 438 for permitting the deformation of the bimorph plate 418 in the shape of arch. By this arrangement it is possible to displace the quantity control valve 410 by a relatively slight deformation of the intermediate portion of the bimorph plate 418. In this way the mechanism for opening and closing the quantity control valve 410 is simplified and is compact.

Figure 45:
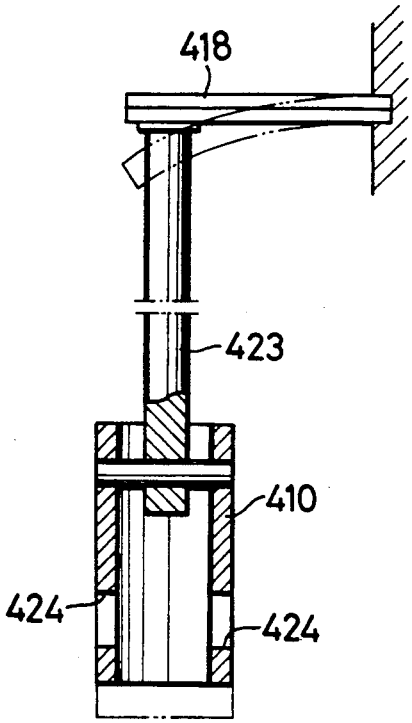
FIG. 45 is a front view of another modified actuator.

Another modification is shown in FIG. 45, in which a singular bimorph plate 418 is used and one end of the plate 418 is fixed. The free end of the plate 418 is connected to the quantity control valve 410 by a connecting rod 423. According to this arrangement, the mechanism for supporting the bimorph plate 418 is more simplified and hence the structure of the injector is simple.

Figure 46:
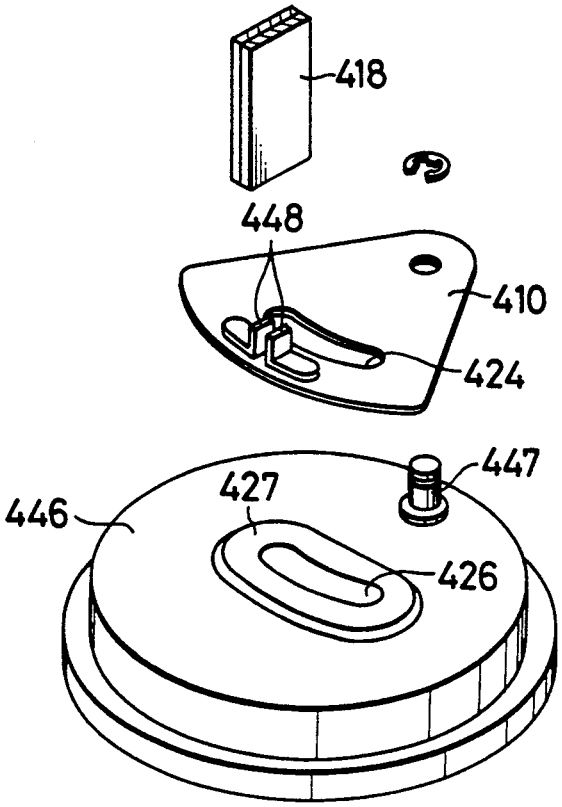
FIG. 46 is a perspective view of another modified embodiment.
Figure 47:
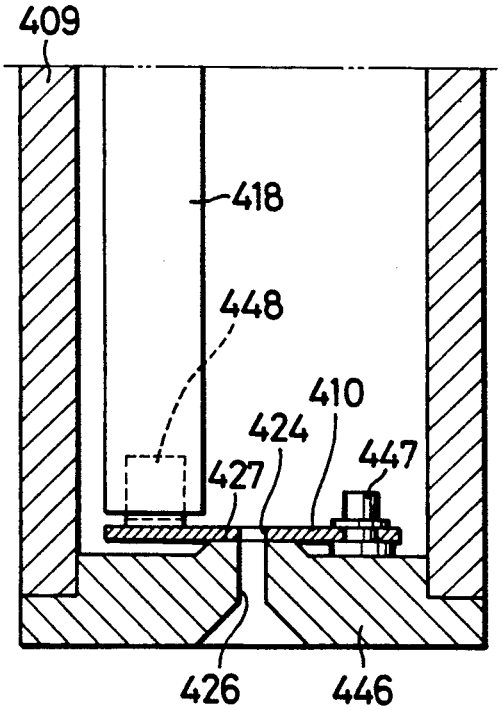
FIG. 47 is a side view of the modified embodiment.
Figure 48:
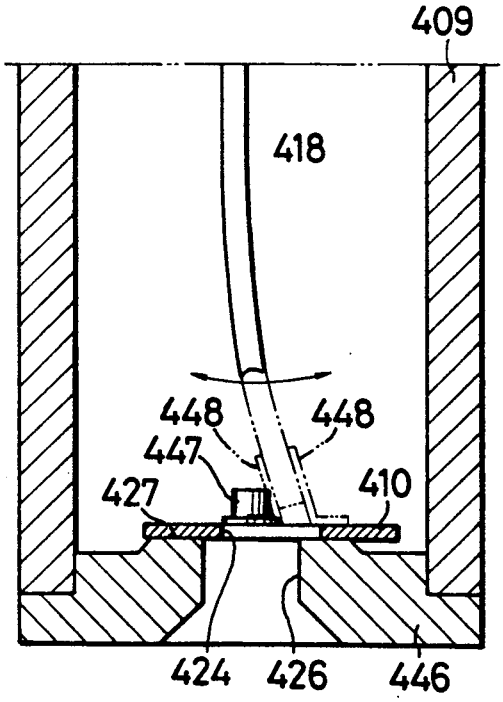
FIG. 48 is a front view of the modified embodiment.

A further modification is shown in FIG. 46 to FIG. 48. In this modification, an injection hole 426 is formed on the bottom or top plate 446 of the nozzle 409 and a valve seat 427 is located at the internal edge of the injection hole 426. A segmental quantity control valve 410 is arranged on the valve seat 427 and is rotatably supported by a pin 447. The top of the valve 410 is connected to the top end of the bimorph plate 418 through engage members 448.

With this arrangement, as shown in FIG. 48, the quantity control valve 410 rotates around the pin 447 when electric voltage is applied on the bimorph plate 418 because the bimorph plate 418 is connected to the quantity control valve 410 by engage members 448. Thus the effective area of the injection hole 426 is changed by the control opening 424 of the quantity control valve 410 to accomplish an operation of quantity control. The injection of the fuel is terminated when the valve 410 rotates to a position where the control openings 424 do not coincide with the injection hole 426. For this reason, it is possible to have the valve 410 constitute not only a quantity control valve but also a timing control valve.

Figure 49:
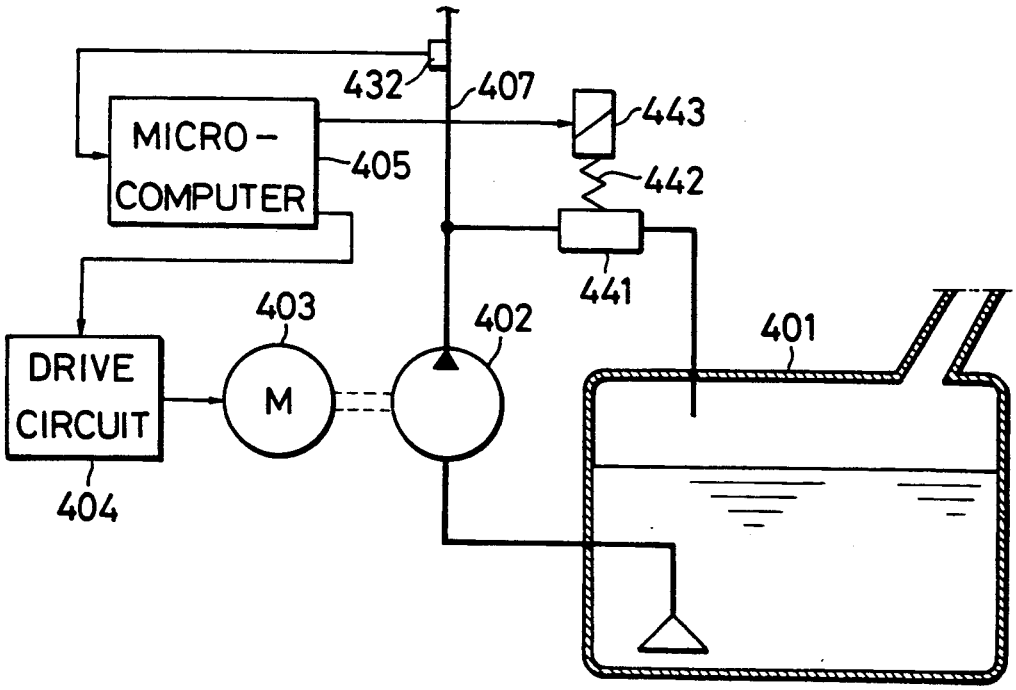
FIG. 49 is a block diagram of a further modified system with a relief valve.

A further modification is shown in FIG. 49. This modification includes a relief valve 441 so that an accumulator can be omitted. The relief valve 441 is connected to a feed pipe 407 for fuel. The spring 442 for controlling the relief pressure of the relief valve 441 is controlled by a microcomputer 405 through an actuator 443. The microcomputer 405 regulates the deformation of the spring 442 through the actuator 443 in response to the output signal of the pressure sensor 432 to control the pressure on which the relief valve 441 operates. With this modification, it is possible to control and keep the output pressure of a feed pump 402 substantially constant, and for this reason, it is possible to accomplish the injection of fuel without an accumulator.

Having described specific embodiments of this invention with reference to accompanying drawings, it must be understood that this invention is not limited to these precise embodiments or modifications. Various changes and other modifications may be effected by one skilled in the art without departing from the scope or spirit of the invention as defined in the appended claims. For example, an actuator of monomorph plate may be used instead of the bimorph plate in the last embodiment, and further magneto-strictive elements may be used for the actuator to control the displacement of the quantity control valve instead of the piezo-electric element. Furthermore, a various materials may be used for the nozzle or the injector, and the nozzle may be made of ceramic materials for protecting the quantity control valve or the piezo-electric element. Furthermore, this invention may be applied not only to the fuel injection apparatus of a Diesel engine but also to a gasoline engine when the pressure of the fuel is reduced.

What is claimed is:

1. A fuel injection apparatus associated with an engine wherein fuel under pressure is supplied to an injector for injecting a mist of fuel through an injection hole of said injector, said injection apparatus comprising:

a cylindrical injection nozzle provided with said injector having at least one injection hole extending radially through the periphery of said injection nozzle;

a quantity control valve slidably disposed inside said injection nozzle for regulating the effective size of said at least one injection hole resulting in controlling the quantity per unit time of the fuel injected;

an actuator for displacing said quantity control valve axially inside the cylindrical injection nozzle; and an electric control means for controlling said actuator in response to the condition of the engine.

2. A fuel injection apparatus associated with an engine in which pressure is supplied to an injector for injecting fuel through an injection hole of the injector, said injection apparatus comprising:

a cylindrical injection nozzle provided with said injector having at least one injection hole formed on the periphery thereof;

a valve seat formed on the inside edge of said injection hole;

a quantity control valve slidably disposed in said injection nozzle and contacting said valve seat for regulating the effective area of said at least one injection hole to thereby control the quantity of the fuel injected at one time;

an actuator for axially displacing said quantity control valve in said cylindrical injection nozzle in response to the condition of the engine.

3. A fuel injection apparatus in which fuel under pressure is supplied to an injector for injecting a mist of fuel through the injector, said injection apparatus comprising:

an injection hole formed on said injector for injecting the fuel therethrough;

a quantity control valve for regulating the effective area of said injection hole;

an actuator for displacing said quantity valve, where the frequency response of the actuator is such that the actuator displaces the quantity control valve during the time duration of every fuel injection cycle;

an electric control means for controlling said actuator in response to the number of revolutions and load of engine, said quantity control valve being controlled by said electric control means through said actuator so that the quantity of fuel injected at one time and the injection pattern of the fuel during the time duration of the injection is regulated.

4. A fuel injection apparatus wherein pressed fuel is supplied to an injector for injecting a mist of fuel, said injection apparatus comprising:

means for continuously applying the fuel under a substantially constant pressure to said injector;

an injection hole formed on said injector for injecting the fuel therethrough;

a quantity control valve for controlling the quantity per unit time of the fuel by regulating the effective area of said injection hole;

an actuator for displacing said quantity control valve; and an electric control means for controlling said actuator in response to the number of revolutions and load of the engine, said quantity control valve being controlled by said electric control means through said actuator so that the integrated quantity of fuel injected from said injection hole during the time duration between the start and termination of the injection by said injector is equal to the quantity to be injected at one time.

5. A fuel injection apparatus wherein pressed fuel is supplied to an injector for injecting a mist of fuel, said injection apparatus comprising:

an injection hole formed on said injector for injecting fluid;

a quantity control valve for controlling the effective area of said injection hole;

the quantity of the fuel injected at one time being controlled by the injection rate determined by the effective area of said injection hole through the time duration from the start of the injection until the termination thereof;

an actuator for displacing said quantity control valve, said actuator moving said quantity control valve in sufficient stroke to close the injection hole, to thereby operate the opening and closing of said injection hole so that said quantity control valve serves as a timing control valve; and an electric control means for controlling said actuator in response to the number of revolutions and load of the engine.

6. A fuel injection apparatus according to claim 4, wherein said apparatus further includes a feed pump for pressing the fuel, and an accumulator for storing the fuel under presssure, the fuel pressed by said feed pump being pushed into said accumulator.

7. A fuel injection apparatus according to claim 6, wherein the pressure of the fuel in the accumulator is detected by a pressure detecting sensor and said feed pump is controlled in response to the detecting signal of said pressure detection sensor to maintain the pressure of the fuel in the accumulator substantially constant.

8. A fuel injection apparatus according to claim 4, wherein said apparatus further includes a feed pump for pressing the fuel, and a relief valve connected to said feed pump, the relief pressure of said relief valve being controlled to maintain the output pressure of said feed pump substantially constant.

9. A fuel injection apparatus according to claim 4, wherein said apparatus further includes a differential gear apparatus for driving a feed pump which presses the fuel, a torque being taken from an engine and the revolutional number of this apparatus being controlled by an electric motor.

10. A fuel injection apparatus according to claim 4, wherein said quantity control valve is a clynder.

11. A fuel injection apparatus according to claim 4, wherein said quantity control valve has a control opening for controlling the effective area of said injection hole in response to the displacement thereof.

12. A fuel injection apparatus according to claim 10, wherein a slit is formed on said quantity control valve for deforming of said valve to contact closely with a valve seat of said injection hole.

13. A fuel injection apparatus according to claim 4, wherein said quantity control valve is axially moved by said actuator.

14. A fuel injection apparatus according to claim 4, wherein said actuator is a piezo-electric element.

15. A fuel injection apparatus according to claim 14, wherein electric voltage applied on said piezo-electric element is changed during the time duration of said injection to thereby displace said quantity control valve during said injection operation.

16. A fuel injection apparatus according to claim 4, wherein said actuator moves said quantity control valve in sufficient stroke to close the injection hole, to thereby operate the opening and closing of said injection hole so that said quantity control valve serves as a timing control valve.

17. A fuel injection apparatus according to claim 2, wherein said injection nozzle is continuously filled with the fuel under pressure, and the pressure of the fuel presses the quantity control valve against said valve seat.

18. A fuel injection apparatus according to claim 2, wherein said quantity control valve has longitudinally extending slits for deforming the quantity control valve radially and the pressure of the fuel is applied on said quantity control valve for urging the close contact with the valve seat of said injection nozzle.

19. A fuel injection apparatus according to claim 2, wherein said actuator moves the quantity control valve sufficiently so that the quantity control valve closes the injection hole of the injector when every cycle of fuel injection is terminated.

* * * * *